US009651286B2

(12) United States Patent
Pham

(10) Patent No.: US 9,651,286 B2
(45) **Date of Patent: *May 16, 2017**

(54) REFRIGERATION MONITORING SYSTEM AND METHOD

(71) Applicant: Emerson Climate Technologies, Inc., Sidney, OH (US)

(72) Inventor: Hung M. Pham, Dayton, OH (US)

(73) Assignee: Emerson Climate Technologies, Inc., Sidney, OH (US)

( * ) Notice: Subject to any disclaimer, the term of this patent is extended or adjusted under 35 U.S.C. 154(b) by 919 days.

This patent is subject to a terminal disclaimer.

(21) Appl. No.: 13/784,890

(22) Filed: Mar. 5, 2013

(65) Prior Publication Data

US 2013/0174588 A1 Jul. 11, 2013

Related U.S. Application Data

(63) Continuation of application No. 12/054,011, filed on Mar. 24, 2008, now Pat. No. 8,393,169.

(Continued)

(51) Int. Cl.
*F25B 45/00* (2006.01)
*F25B 49/02* (2006.01)

(Continued)

(52) U.S. Cl.
CPC ..... *F25B 49/02* (2013.01); *F25B 39/04* (2013.01); *F25B 45/00* (2013.01); *F25B 49/005* (2013.01);

(Continued)

(58) Field of Classification Search
USPC ..... 62/149, 127, 129, 208
See application file for complete search history.

(56) References Cited

U.S. PATENT DOCUMENTS 2,054,542 A 9/1936 Hoelle
2,961,606 A 11/1960 Mead (Continued)

FOREIGN PATENT DOCUMENTS

CA 2528778 A1 12/2004
CN 1133425 A 10/1996

(Continued)

OTHER PUBLICATIONS

"A Practical Example of a Building's Automatic Control," cited in First Office Action from the Patent Office of the People's Republic of China dated Jun. 29, 2007, regarding Application No. 200510005907.8, including translation by CCPIT Patent and Trademark Law Office.

(Continued)

*Primary Examiner* — Jonathan Bradford
(74) *Attorney, Agent, or Firm* — Harness, Dickey & Pierce, P.L.C.

(57) ABSTRACT

A system is provided and may include a refrigeration circuit having a condenser, a first sensor producing a signal indicative of a detected condenser temperature of the condenser, and processing circuitry in communication with the first sensor. The processing circuitry may determine a derived condenser temperature independent from information received from the first sensor and may compare the derived condenser temperature to the detected condenser temperature to determine a charge level of the refrigeration circuit.

19 Claims, 11 Drawing Sheets

Related U.S. Application Data

(60) Provisional application No. 60/973,583, filed on Sep. 19, 2007.

(51) Int. Cl.
*F25B 49/00* (2006.01)
*F25B 39/04* (2006.01)

(52) U.S. Cl.
CPC ..... *F25B 2700/04* (2013.01); *F25B 2700/151* (2013.01); *F25B 2700/2116* (2013.01); *F25B 2700/21163* (2013.01)

(56) References Cited

U.S. PATENT DOCUMENTS 2,978,879 A 4/1961 Heidorn
3,047,696 A 7/1962 Heidorn
3,107,843 A 10/1963 Finn
3,170,304 A 2/1965 Hale
3,232,519 A 2/1966 Long
3,278,111 A 10/1966 Parker
3,339,164 A 8/1967 Landis et al.
3,665,339 A 5/1972 Liu
3,665,399 A 5/1972 Zehr et al.
3,729,949 A 5/1973 Talbot
3,735,377 A 5/1973 Kaufman
3,742,303 A 6/1973 Dageford
3,783,681 A 1/1974 Hirt et al.
3,927,712 A 12/1975 Nakayama
3,935,519 A 1/1976 Pfarrer et al.
3,950,962 A 4/1976 Odashima
3,960,011 A 6/1976 Renz et al.
3,978,382 A 8/1976 Pfarrer et al.
3,998,068 A 12/1976 Chirnside
4,014,182 A 3/1977 Granryd
4,018,584 A 4/1977 Mullen
4,024,725 A 5/1977 Uchida et al.
4,034,570 A 7/1977 Anderson et al.
4,038,061 A 7/1977 Anderson et al.
4,046,532 A 9/1977 Nelson
4,060,716 A 11/1977 Pekrul et al.
4,066,869 A 1/1978 Apaloo et al.
4,090,248 A 5/1978 Swanson et al.
4,102,394 A 7/1978 Botts
4,104,888 A 8/1978 Reedy et al.
4,105,063 A 8/1978 Bergt
4,112,703 A 9/1978 Kountz
4,136,730 A 1/1979 Kinsey
4,137,057 A 1/1979 Piet et al.
4,137,725 A 2/1979 Martin
4,142,375 A 3/1979 Abe et al.
4,143,707 A 3/1979 Lewis et al.
4,146,085 A 3/1979 Wills
RE29,966 E 4/1979 Nussbaum
4,156,350 A 5/1979 Elliott et al.
4,161,106 A 7/1979 Savage et al.
4,165,619 A 8/1979 Girard
4,171,622 A 10/1979 Yamaguchi et al.
4,173,871 A 11/1979 Brooks
4,178,988 A 12/1979 Cann et al.
RE30,242 E 4/1980 del Toro et al.
4,209,994 A 7/1980 Mueller et al.
4,211,089 A 7/1980 Mueller et al.
4,220,010 A 9/1980 Mueller et al.
4,227,862 A 10/1980 Andrew et al.
4,232,530 A 11/1980 Mueller
4,233,818 A 11/1980 Lastinger
4,236,379 A 12/1980 Mueller
4,244,182 A 1/1981 Behr
4,246,763 A 1/1981 Mueller et al.
4,248,051 A 2/1981 Darcy et al.
4,251,988 A 2/1981 Allard et al.
4,257,795 A 3/1981 Shaw
4,259,847 A 4/1981 Pearse, Jr.
4,267,702 A 5/1981 Houk
4,271,898 A 6/1981 Freeman
4,286,438 A 9/1981 Clarke
4,290,480 A 9/1981 Sulkowski
4,301,660 A 11/1981 Mueller et al.
4,307,775 A 12/1981 Saunders et al.
4,311,188 A 1/1982 Kojima et al.
4,319,461 A 3/1982 Shaw
4,321,529 A 3/1982 Simmonds et al.
4,325,223 A 4/1982 Cantley
4,328,678 A 5/1982 Kono et al.
4,328,680 A 5/1982 Stamp, Jr. et al.
4,333,316 A 6/1982 Stamp, Jr. et al.
4,333,317 A 6/1982 Sawyer
4,336,001 A 6/1982 Andrew et al.
4,338,790 A 7/1982 Saunders et al.
4,338,791 A 7/1982 Stamp, Jr. et al.
4,345,162 A 8/1982 Hammer et al.
4,350,021 A 9/1982 Lundstrom
4,350,023 A 9/1982 Kuwabara et al.
4,356,703 A 11/1982 Vogel
4,361,273 A 11/1982 Levine et al.
4,365,983 A 12/1982 Abraham et al.
4,370,098 A 1/1983 McClain et al.
4,372,119 A 2/1983 Gillbrand et al.
4,376,926 A 3/1983 Senor
4,381,549 A 4/1983 Stamp, Jr. et al.
4,382,367 A 5/1983 Roberts
4,384,462 A 5/1983 Overman et al.
4,387,368 A 6/1983 Day, III et al.
4,390,321 A 6/1983 Langlois et al.
4,390,922 A 6/1983 Pelliccia
4,395,886 A 8/1983 Mayer
4,395,887 A 8/1983 Sweetman
4,399,548 A 8/1983 Castleberry
4,406,133 A 9/1983 Saunders et al.
4,407,138 A 10/1983 Mueller
4,408,660 A 10/1983 Sutoh et al.
4,425,010 A 1/1984 Bryant et al.
4,429,578 A 2/1984 Darrel et al.
4,441,329 A 4/1984 Dawley
4,448,038 A 5/1984 Barbier
4,449,375 A 5/1984 Briccetti
4,460,123 A 7/1984 Beverly
4,463,571 A 8/1984 Wiggs
4,465,229 A 8/1984 Kompelien
4,467,230 A 8/1984 Rovinsky
4,467,385 A 8/1984 Bandoli et al.
4,467,613 A 8/1984 Behr et al.
4,470,092 A 9/1984 Lombardi
4,470,266 A 9/1984 Briccetti et al.
4,474,024 A 10/1984 Eplett et al.
4,474,542 A 10/1984 Kato et al.
4,479,389 A 10/1984 Anderson, III et al.
4,484,452 A 11/1984 Houser, Jr.
4,489,551 A 12/1984 Watanabe et al.
4,495,779 A 1/1985 Tanaka et al.
4,496,296 A 1/1985 Arai et al.
4,497,031 A 1/1985 Froehling et al.
4,498,310 A 2/1985 Imanishi et al.
4,499,739 A 2/1985 Matsuoka et al.
4,502,084 A 2/1985 Hannett
4,502,833 A 3/1985 Hibino et al.
4,502,842 A 3/1985 Currier et al.
4,502,843 A 3/1985 Martin
4,506,518 A 3/1985 Yoshikawa et al.
4,507,934 A 4/1985 Tanaka et al.
4,510,547 A 4/1985 Rudich, Jr.
4,510,576 A 4/1985 MacArthur et al.
4,512,161 A 4/1985 Logan et al.
4,516,407 A 5/1985 Watabe
4,520,674 A 6/1985 Canada et al.
4,523,435 A 6/1985 Lord
4,523,436 A 6/1985 Schedel et al.
4,527,399 A 7/1985 Lord
4,535,607 A 8/1985 Mount
4,538,420 A 9/1985 Nelson
4,538,422 A 9/1985 Mount et al.
4,539,820 A 9/1985 Zinsmeyer
4,545,210 A 10/1985 Lord

(56) References Cited

U.S. PATENT DOCUMENTS 4,545,214 A 10/1985 Kinoshita
4,548,549 A 10/1985 Murphy et al.
4,549,403 A 10/1985 Lord et al.
4,549,404 A 10/1985 Lord
4,550,770 A 11/1985 Nussdorfer et al.
4,555,057 A 11/1985 Foster
4,557,317 A 12/1985 Harmon, Jr.
4,561,260 A 12/1985 Nishi et al.
4,563,624 A 1/1986 Yu
4,563,877 A 1/1986 Harnish
4,574,871 A 3/1986 Parkinson et al.
4,580,947 A 4/1986 Shibata et al.
4,583,373 A 4/1986 Shaw
4,589,060 A 5/1986 Zinsmeyer
4,598,764 A 7/1986 Beckey
4,602,484 A 7/1986 Bendikson
4,603,556 A 8/1986 Suefuji et al.
4,611,470 A 9/1986 Enstrom
4,612,775 A 9/1986 Branz et al.
4,614,089 A 9/1986 Dorsey
4,617,804 A 10/1986 Fukushima et al.
4,620,424 A 11/1986 Tanaka et al.
4,621,502 A 11/1986 Ibrahim et al.
4,627,245 A 12/1986 Levine
4,627,483 A 12/1986 Harshbarger, III et al.
4,627,484 A 12/1986 Harshbarger, Jr. et al.
4,630,670 A 12/1986 Wellman et al.
4,642,034 A 2/1987 Terauchi
4,646,532 A 3/1987 Nose
4,649,710 A 3/1987 Inoue et al.
4,653,280 A 3/1987 Hansen et al.
4,653,285 A 3/1987 Pohl
4,655,688 A 4/1987 Bohn et al.
4,660,386 A 4/1987 Hansen et al.
4,662,184 A 5/1987 Pohl et al.
4,674,292 A 6/1987 Ohya et al.
4,677,830 A 7/1987 Sumikawa et al.
4,680,940 A 7/1987 Vaughn
4,682,473 A 7/1987 Rogers, III
4,684,060 A 8/1987 Adams et al.
4,686,835 A 8/1987 Alsenz
4,689,967 A 9/1987 Han et al.
4,697,431 A 10/1987 Alsenz
4,698,978 A 10/1987 Jones
4,698,981 A 10/1987 Kaneko et al.
4,701,824 A 10/1987 Beggs et al.
4,706,152 A 11/1987 DeFilippis et al.
4,706,469 A 11/1987 Oguni et al.
4,712,648 A 12/1987 Mattes et al.
4,713,717 A 12/1987 Pejouhy et al.
4,715,190 A 12/1987 Han et al.
4,720,980 A 1/1988 Howland
4,735,054 A 4/1988 Beckey
4,735,060 A 4/1988 Alsenz
4,744,223 A 5/1988 Umezu
4,745,765 A 5/1988 Pettitt
4,745,766 A 5/1988 Bahr
4,745,767 A 5/1988 Ohya et al.
4,750,332 A 6/1988 Jenski et al.
4,750,672 A 6/1988 Beckey et al.
4,751,825 A 6/1988 Voorhis et al.
4,755,957 A 7/1988 White et al.
4,765,150 A 8/1988 Persem
4,768,348 A 9/1988 Noguchi
4,790,142 A 12/1988 Beckey
4,796,142 A 1/1989 Libert
4,798,055 A 1/1989 Murray et al.
4,805,118 A 2/1989 Rishel
4,807,445 A 2/1989 Matsuoka et al.
4,820,130 A 4/1989 Eber et al.
4,829,779 A 5/1989 Munson et al.
4,831,560 A 5/1989 Zaleski
4,835,980 A 6/1989 Oyanagi et al.
4,841,734 A 6/1989 Torrence
4,845,956 A 7/1989 Berntsen et al.
4,848,099 A 7/1989 Beckey et al.
4,848,100 A 7/1989 Barthel et al.
4,850,198 A 7/1989 Helt et al.
4,850,204 A 7/1989 Bos et al.
4,852,363 A 8/1989 Kampf et al.
4,856,286 A 8/1989 Sulfstede et al.
4,858,676 A 8/1989 Bolfik et al.
4,866,944 A 9/1989 Yamazaki
4,869,073 A 9/1989 Kawai et al.
4,873,836 A 10/1989 Thompson
4,877,382 A 10/1989 Caillat et al.
4,878,355 A 11/1989 Beckey et al.
4,881,184 A 11/1989 Abegg, III et al.
4,882,908 A 11/1989 White
4,884,412 A 12/1989 Sellers et al.
4,885,707 A 12/1989 Nichol et al.
4,885,914 A 12/1989 Pearman
4,887,436 A 12/1989 Enomoto et al.
4,887,857 A 12/1989 VanOmmeren
4,889,280 A 12/1989 Grald et al.
4,893,480 A 1/1990 Matsui et al.
4,899,551 A 2/1990 Weintraub
4,903,500 A 2/1990 Hanson
4,909,041 A 3/1990 Jones
4,909,076 A 3/1990 Busch et al.
4,910,966 A 3/1990 Levine et al.
4,913,625 A 4/1990 Gerlowski
4,916,912 A 4/1990 Levine et al.
4,918,932 A 4/1990 Gustafson et al.
4,932,588 A 6/1990 Fedter et al.
4,939,909 A 7/1990 Tsuchiyama et al.
4,943,003 A 7/1990 Shimizu et al.
4,944,160 A 7/1990 Malone et al.
4,945,491 A 7/1990 Rishel
4,953,784 A 9/1990 Yasufuku et al.
4,959,970 A 10/1990 Meckler
4,964,060 A 10/1990 Hartsog
4,966,006 A 10/1990 Thuesen et al.
4,967,567 A 11/1990 Proctor et al.
4,970,496 A 11/1990 Kirkpatrick
4,974,665 A 12/1990 Zillner, Jr.
4,975,024 A 12/1990 Heckel
4,977,751 A 12/1990 Hanson
4,985,857 A 1/1991 Bajpai et al.
4,987,748 A 1/1991 Meckler
4,990,057 A 2/1991 Rollins
4,991,770 A 2/1991 Bird et al.
5,000,009 A 3/1991 Clanin
5,009,075 A 4/1991 Okoren
5,009,076 A 4/1991 Winslow
5,012,629 A 5/1991 Rehman et al.
5,018,665 A 5/1991 Sulmone
RE33,620 E 6/1991 Persem
5,042,264 A 8/1991 Dudley
5,056,036 A 10/1991 Van Bork
5,056,329 A 10/1991 Wilkinson
5,058,388 A 10/1991 Shaw et al.
5,062,278 A 11/1991 Sugiyama
5,065,593 A 11/1991 Dudley et al.
RE33,775 E 12/1991 Behr et al.
5,071,065 A 12/1991 Aalto et al.
5,073,091 A 12/1991 Burgess et al.
5,073,862 A 12/1991 Carlson
5,076,067 A 12/1991 Prenger et al.
5,076,494 A 12/1991 Ripka
5,077,983 A 1/1992 Dudley
5,094,086 A 3/1992 Shyu
5,095,712 A 3/1992 Narreau
5,095,715 A 3/1992 Dudley
5,102,316 A 4/1992 Caillat et al.
5,103,391 A 4/1992 Barrett
5,109,676 A 5/1992 Waters et al.
5,109,700 A 5/1992 Hicho
5,115,406 A 5/1992 Zatezalo et al.
5,115,643 A 5/1992 Hayata et al.
5,115,644 A 5/1992 Alsenz
5,118,260 A 6/1992 Fraser, Jr.
5,119,466 A 6/1992 Suzuki
5,119,637 A 6/1992 Bard et al.

(56) References Cited

U.S. PATENT DOCUMENTS 5,121,610 A 6/1992 Atkinson et al.
5,123,252 A 6/1992 Hanson
5,123,253 A 6/1992 Hanson et al.
5,123,255 A 6/1992 Ohizumi
RE34,001 E 7/1992 Wrobel
5,136,855 A 8/1992 Lenarduzzi
5,140,394 A 8/1992 Cobb, III et al.
5,141,407 A 8/1992 Ramsey et al.
5,142,877 A 9/1992 Shimizu
5,167,494 A 12/1992 Inagaki et al.
5,170,935 A 12/1992 Federspiel et al.
5,170,936 A 12/1992 Kubo et al.
5,186,014 A 2/1993 Runk
5,199,855 A 4/1993 Nakajima et al.
5,200,872 A 4/1993 D'Entremont et al.
5,201,862 A 4/1993 Pettitt
5,203,178 A 4/1993 Shyu
5,209,076 A 5/1993 Kauffman et al.
5,209,400 A 5/1993 Winslow et al.
5,219,041 A 6/1993 Greve
5,224,354 A 7/1993 Ito et al.
5,224,835 A 7/1993 Oltman
5,228,300 A 7/1993 Shim
5,228,307 A 7/1993 Koce
5,231,844 A 8/1993 Park
5,233,841 A 8/1993 Jyrek
5,237,830 A 8/1993 Grant
5,241,833 A 9/1993 Ohkoshi
5,243,829 A 9/1993 Bessler
5,248,244 A 9/1993 Ho et al.
5,251,454 A 10/1993 Yoon
5,257,506 A 11/1993 DeWolf et al.
5,271,556 A 12/1993 Helt et al.
5,276,630 A 1/1994 Baldwin et al.
5,279,458 A 1/1994 DeWolf et al.
5,290,154 A 3/1994 Kotlarek et al.
5,291,752 A 3/1994 Alvarez et al.
5,299,504 A 4/1994 Abele
5,303,560 A 4/1994 Hanson et al.
5,311,451 A 5/1994 Barrett
5,320,506 A 6/1994 Fogt
5,333,460 A 8/1994 Lewis et al.
5,335,507 A 8/1994 Powell
5,336,058 A 8/1994 Yokoyama
5,337,576 A 8/1994 Dorfman et al.
5,362,206 A 11/1994 Westerman et al.
5,362,211 A 11/1994 Iizuka et al.
5,368,446 A 11/1994 Rode
5,381,669 A 1/1995 Bahel et al.
5,381,692 A 1/1995 Winslow et al.
5,416,781 A 5/1995 Ruiz
5,423,190 A 6/1995 Friedland
5,423,192 A 6/1995 Young et al.
5,435,148 A 7/1995 Sandofsky et al.
5,440,890 A 8/1995 Bahel et al.
5,440,895 A 8/1995 Bahel et al.
5,446,677 A 8/1995 Jensen et al.
5,454,229 A 10/1995 Hanson et al.
5,460,006 A 10/1995 Torimitsu
5,469,045 A 11/1995 Dove et al.
5,475,986 A 12/1995 Bahel et al.
5,481,481 A 1/1996 Frey et al.
5,499,512 A 3/1996 Jurewicz et al.
5,509,786 A 4/1996 Mizutani et al.
5,511,387 A 4/1996 Tinsler
5,519,337 A 5/1996 Casada
5,528,908 A 6/1996 Bahel et al.
5,532,534 A 7/1996 Baker et al.
5,533,347 A 7/1996 Ott et al.
5,535,597 A 7/1996 An
5,546,015 A 8/1996 Okabe
5,548,966 A 8/1996 Tinsler
5,562,426 A 10/1996 Watanabe et al.
5,579,648 A 12/1996 Hanson et al.
5,586,445 A 12/1996 Bessler
5,592,824 A 1/1997 Sogabe et al.
5,596,507 A 1/1997 Jones et al.
5,602,757 A 2/1997 Haseley et al.
5,610,339 A 3/1997 Haseley et al.
5,611,674 A 3/1997 Bass et al.
5,613,841 A 3/1997 Bass et al.
5,615,071 A 3/1997 Higashikata et al.
5,616,829 A 4/1997 Balaschak et al.
5,623,834 A 4/1997 Bahel et al.
5,628,201 A 5/1997 Bahel et al.
5,630,325 A 5/1997 Bahel et al.
5,641,270 A 6/1997 Sgourakes et al.
5,651,263 A 7/1997 Nonaka et al.
5,655,379 A 8/1997 Jaster et al.
5,656,765 A 8/1997 Gray
5,656,767 A 8/1997 Garvey, III et al.
5,666,815 A 9/1997 Aloise
5,689,963 A 11/1997 Bahel et al.
5,691,692 A 11/1997 Herbstritt
5,699,670 A 12/1997 Jurewicz et al.
5,707,210 A 1/1998 Ramsey et al.
5,713,724 A 2/1998 Centers et al.
5,737,931 A 4/1998 Ueno et al.
5,741,120 A 4/1998 Bass et al.
5,754,450 A 5/1998 Solomon et al.
5,772,403 A 6/1998 Allison et al.
5,782,101 A 7/1998 Dennis
5,795,381 A 8/1998 Holder
5,798,941 A 8/1998 McLeister
5,802,860 A 9/1998 Barrows
5,807,336 A 9/1998 Russo et al.
5,808,441 A 9/1998 Nehring
5,857,348 A 1/1999 Conry
5,869,960 A 2/1999 Brand
5,875,638 A 3/1999 Tinsler
5,884,494 A 3/1999 Okoren et al.
5,924,295 A 7/1999 Park
5,947,701 A 9/1999 Hugenroth
5,950,443 A 9/1999 Meyer et al.
5,956,658 A 9/1999 McMahon
5,971,712 A 10/1999 Kann
5,975,854 A 11/1999 Culp, III et al.
5,984,645 A 11/1999 Cummings
5,987,903 A 11/1999 Bathla
5,988,986 A 11/1999 Brinken et al.
5,995,347 A 11/1999 Rudd et al.
5,995,351 A 11/1999 Katsumata et al.
6,017,192 A 1/2000 Clack et al.
6,020,702 A 2/2000 Farr
6,023,420 A 2/2000 McCormick et al.
6,035,653 A 3/2000 Itoh et al.
6,035,661 A 3/2000 Sunaga et al.
6,041,605 A 3/2000 Heinrichs
6,041,609 A 3/2000 Hornsleth et al.
6,042,344 A 3/2000 Lifson
6,047,557 A 4/2000 Pham et al.
6,050,780 A 4/2000 Hasegawa et al.
6,057,771 A 5/2000 Lakra
6,065,946 A 5/2000 Lathrop
6,068,447 A 5/2000 Foege
6,077,051 A 6/2000 Centers et al.
6,081,750 A 6/2000 Hoffberg et al.
6,082,495 A 7/2000 Steinbarger et al.
6,082,971 A 7/2000 Gunn et al.
6,085,530 A 7/2000 Barito
6,092,370 A 7/2000 Tremoulet, Jr. et al.
6,092,378 A 7/2000 Das et al.
6,092,992 A 7/2000 Imblum et al.
6,102,665 A 8/2000 Centers et al.
6,125,642 A 10/2000 Seener et al.
6,128,583 A 10/2000 Dowling
6,129,527 A 10/2000 Donahoe et al.
6,142,741 A 11/2000 Nishihata et al.
6,157,310 A 12/2000 Milne et al.
6,158,230 A 12/2000 Katsuki
6,174,136 B1 1/2001 Kilayko et al.
6,176,683 B1 1/2001 Yang
6,176,686 B1 1/2001 Wallis et al.
6,179,214 B1 1/2001 Key et al.

(56) References Cited

U.S. PATENT DOCUMENTS 6,181,033 B1 1/2001 Wright
6,199,018 B1 3/2001 Quist et al.
6,260,004 B1 7/2001 Hays et al.
6,276,901 B1 8/2001 Farr et al.
6,279,332 B1 8/2001 Yeo et al.
6,302,654 B1 10/2001 Millet et al.
6,320,275 B1 11/2001 Okamoto et al.
6,324,854 B1 12/2001 Jayanth
6,332,327 B1 12/2001 Street et al.
6,360,551 B1 3/2002 Renders
6,375,439 B1 4/2002 Missio
6,381,971 B2 5/2002 Honda
6,390,779 B1 5/2002 Cunkelman
6,406,265 B1 6/2002 Hahn et al.
6,406,266 B1 6/2002 Hugenroth et al.
6,412,293 B1 7/2002 Pham et al.
6,438,981 B1 8/2002 Whiteside
6,442,953 B1 9/2002 Trigiani et al.
6,449,972 B2 9/2002 Pham et al.
6,450,771 B1 9/2002 Centers et al.
6,453,687 B2 9/2002 Sharood et al.
6,454,538 B1 9/2002 Witham et al.
6,457,319 B1 10/2002 Ota et al.
6,457,948 B1 10/2002 Pham
6,467,280 B2 10/2002 Pham et al.
6,471,486 B1 10/2002 Centers et al.
6,484,520 B2 11/2002 Kawaguchi et al.
6,487,457 B1 11/2002 Hull et al.
6,492,923 B1 12/2002 Inoue et al.
6,497,554 B2 12/2002 Yang et al.
6,501,240 B2 12/2002 Ueda et al.
6,501,629 B1 12/2002 Marriott
6,502,409 B1 1/2003 Gatling et al.
6,505,475 B1 1/2003 Zugibe et al.
6,529,590 B1 3/2003 Centers
6,533,552 B2 3/2003 Centers et al.
6,535,270 B1 3/2003 Murayama
6,537,034 B2 3/2003 Kim et al.
6,542,062 B1 4/2003 Herrick
6,558,126 B1 5/2003 Hahn et al.
6,560,976 B2 5/2003 Jayanth
6,571,566 B1 6/2003 Temple et al.
6,571,586 B1 6/2003 Ritson et al.
6,589,029 B1 7/2003 Heller
6,595,757 B2 7/2003 Shen
6,601,397 B2 8/2003 Pham et al.
6,615,594 B2 9/2003 Jayanth et al.
6,616,415 B1 9/2003 Renken et al.
6,629,420 B2 10/2003 Renders
6,630,749 B1 10/2003 Takagi et al.
6,647,735 B2 11/2003 Street et al.
6,658,345 B2 12/2003 Miller
6,658,373 B2 12/2003 Rossi et al.
6,672,846 B2 1/2004 Rajendran et al.
6,675,591 B2 1/2004 Singh et al.
6,679,072 B2 1/2004 Pham et al.
6,685,438 B2 2/2004 Yoo et al.
6,709,244 B2 3/2004 Pham
6,711,911 B1 3/2004 Grabon et al.
6,757,665 B1 6/2004 Unsworth et al.
6,758,050 B2 7/2004 Jayanth et al.
6,758,051 B2 7/2004 Jayanth et al.
6,760,207 B2 7/2004 Wyatt et al.
6,799,951 B2 10/2004 Lifson et al.
6,811,380 B2 11/2004 Kim
6,813,897 B1 11/2004 Bash et al.
6,823,680 B2 11/2004 Jayanth
6,829,542 B1 12/2004 Reynolds et al.
6,832,120 B1 12/2004 Frank et al.
6,832,898 B2 12/2004 Yoshida et al.
6,869,272 B2 3/2005 Odachi et al.
6,934,862 B2 8/2005 Sharood et al.
6,953,630 B2 10/2005 Wells
6,964,558 B2 11/2005 Hahn et al.
6,966,759 B2 11/2005 Hahn et al.
6,973,794 B2 12/2005 Street et al.
6,981,384 B2 1/2006 Dobmeier et al.
6,986,469 B2 1/2006 Gauthier et al.
6,992,452 B1 1/2006 Sachs et al.
6,998,807 B2 2/2006 Phillips et al.
6,999,996 B2 2/2006 Sunderland
7,000,422 B2 2/2006 Street et al.
7,047,753 B2 5/2006 Street et al.
7,079,967 B2 7/2006 Rossi et al.
7,113,376 B2 9/2006 Nomura et al.
7,123,458 B2 10/2006 Mohr et al.
7,124,728 B2 10/2006 Carey et al.
7,130,170 B2 10/2006 Wakefield et al.
7,134,295 B2 11/2006 Maekawa
7,174,728 B2 2/2007 Jayanth
7,228,691 B2 6/2007 Street et al.
7,270,278 B2 9/2007 Street et al.
7,412,842 B2 8/2008 Pham
7,421,850 B2 9/2008 Street et al.
7,444,251 B2 10/2008 Nikovski et al.
7,447,603 B2 11/2008 Bruno
7,458,223 B2 12/2008 Pham
7,484,376 B2 2/2009 Pham
7,491,034 B2 2/2009 Jayanth
7,552,596 B2 6/2009 Galante et al.
7,878,006 B2 2/2011 Pham
8,018,182 B2 9/2011 Roehm et al.
8,031,455 B2 10/2011 Paik et al.
8,625,244 B2 1/2014 Paik et al.
9,168,315 B1 10/2015 Scaringe et al.
9,310,439 B2 4/2016 Pham et al.
2001/0005320 A1 6/2001 Ueda et al.
2001/0025349 A1 9/2001 Sharood et al.
2001/0054293 A1 12/2001 Gustafson et al.
2001/0054294 A1 12/2001 Tsuboi
2002/0018724 A1 2/2002 Millet et al.
2002/0020175 A1 2/2002 Street et al.
2002/0040280 A1 4/2002 Morgan
2002/0059803 A1 5/2002 Jayanth
2002/0064463 A1 5/2002 Park et al.
2002/0067999 A1 6/2002 Suitou et al.
2002/0093259 A1 7/2002 Sunaga et al.
2002/0127120 A1 9/2002 Hahn et al.
2002/0138217 A1 9/2002 Shen et al.
2002/0139128 A1 10/2002 Suzuki et al.
2002/0157409 A1 10/2002 Pham et al.
2002/0159890 A1 10/2002 Kajiwara et al.
2002/0170299 A1 11/2002 Jayanth et al.
2003/0019221 A1 1/2003 Rossi et al.
2003/0037555 A1 2/2003 Street et al.
2003/0055663 A1 3/2003 Struble
2003/0078742 A1 4/2003 VanderZee et al.
2003/0094004 A1 5/2003 Pham et al.
2003/0108430 A1 6/2003 Yoshida et al.
2003/0115890 A1 6/2003 Jayanth et al.
2004/0016241 A1 1/2004 Street et al.
2004/0016244 A1 1/2004 Street et al.
2004/0016251 A1 1/2004 Street et al.
2004/0016253 A1 1/2004 Street et al.
2004/0024495 A1 2/2004 Sunderland
2004/0026522 A1 2/2004 Keen et al.
2004/0037706 A1 2/2004 Hahn et al.
2004/0042904 A1 3/2004 Kim
2004/0093879 A1 5/2004 Street et al.
2004/0133367 A1 7/2004 Hart
2004/0144106 A1 7/2004 Douglas et al.
2004/0159114 A1 8/2004 Demuth et al.
2004/0184627 A1 9/2004 Kost et al.
2004/0184928 A1 9/2004 Millet et al.
2004/0184929 A1 9/2004 Millet et al.
2004/0184930 A1 9/2004 Millet et al.
2004/0184931 A1 9/2004 Millet et al.
2004/0187502 A1 9/2004 Jayanth et al.
2004/0191073 A1 9/2004 Iimura et al.
2004/0199480 A1 10/2004 Unsworth et al.
2004/0258542 A1 12/2004 Wiertz et al.
2004/0261431 A1 12/2004 Singh et al.
2005/0040249 A1 2/2005 Wacker et al.
2005/0053471 A1 3/2005 Hong et al.

(56) References Cited

U.S. PATENT DOCUMENTS

| | | | |
|---|---|---|---|
| 2005/0066675 | A1 | 3/2005 | Manole et al. |
| 2005/0100449 | A1 | 5/2005 | Hahn et al. |
| 2005/0103036 | A1 | 5/2005 | Maekawa |
| 2005/0154495 | A1 | 7/2005 | Shah |
| 2005/0159924 | A1 | 7/2005 | Shah et al. |
| 2005/0166610 | A1 | 8/2005 | Jayanth |
| 2005/0172647 | A1 | 8/2005 | Thybo et al. |
| 2005/0196285 | A1 | 9/2005 | Jayanth |
| 2005/0214148 | A1 | 9/2005 | Ogawa et al. |
| 2005/0232781 | A1 | 10/2005 | Herbert et al. |
| 2005/0235660 | A1 | 10/2005 | Pham |
| 2005/0235661 | A1 | 10/2005 | Pham |
| 2005/0235662 | A1 | 10/2005 | Pham |
| 2005/0235663 | A1 | 10/2005 | Pham |
| 2005/0252220 | A1 | 11/2005 | Street et al. |
| 2005/0262856 | A1 | 12/2005 | Street et al. |
| 2006/0021362 | A1 | 2/2006 | Sadegh et al. |
| 2006/0042276 | A1* | 3/2006 | Doll et al. ..... 62/129 |
| 2006/0071666 | A1 | 4/2006 | Unsworth et al. |
| 2006/0117773 | A1 | 6/2006 | Street et al. |
| 2006/0129339 | A1 | 6/2006 | Bruno |
| 2006/0137364 | A1 | 6/2006 | Braun et al. |
| 2006/0151037 | A1 | 7/2006 | Lepola et al. |
| 2006/0182635 | A1 | 8/2006 | Jayanth |
| 2006/0185373 | A1 | 8/2006 | Butler et al. |
| 2006/0229739 | A1 | 10/2006 | Morikawa |
| 2006/0256488 | A1 | 11/2006 | Benzing et al. |
| 2006/0280627 | A1 | 12/2006 | Jayanth |
| 2007/0002505 | A1 | 1/2007 | Watanabe et al. |
| 2008/0000241 | A1 | 1/2008 | Larsen et al. |
| 2008/0183424 | A1 | 7/2008 | Seem |
| 2008/0209925 | A1 | 9/2008 | Pham |
| 2008/0216494 | A1 | 9/2008 | Pham et al. |
| 2008/0315000 | A1 | 12/2008 | Gorthala et al. |
| 2009/0071175 | A1 | 3/2009 | Pham |
| 2009/0094998 | A1 | 4/2009 | McSweeney et al. |
| 2009/0125257 | A1 | 5/2009 | Jayanth et al. |
| 2010/0089076 | A1 | 4/2010 | Schuster et al. |
| 2010/0111709 | A1 | 5/2010 | Jayanth |
| 2010/0191487 | A1 | 7/2010 | Rada et al. |
| 2010/0214709 | A1 | 8/2010 | Hall et al. |
| 2010/0217550 | A1 | 8/2010 | Crabtree et al. |
| 2011/0083450 | A1 | 4/2011 | Turner et al. |
| 2011/0112814 | A1 | 5/2011 | Clark |
| 2011/0144944 | A1 | 6/2011 | Pham |
| 2012/0054242 | A1 | 3/2012 | Ferrara et al. |
| 2012/0179300 | A1 | 7/2012 | Warren et al. |
| 2012/0265586 | A1 | 10/2012 | Mammone |
| 2012/0271673 | A1 | 10/2012 | Riley |
| 2013/0066479 | A1 | 3/2013 | Shetty et al. |
| 2013/0156607 | A1 | 6/2013 | Jayanth |
| 2013/0166231 | A1 | 6/2013 | Jayanth et al. |
| 2013/0176649 | A1 | 7/2013 | Wallis et al. |
| 2013/0294933 | A1 | 11/2013 | Pham |
| 2014/0069121 | A1 | 3/2014 | Pham |
| 2014/0074730 | A1 | 3/2014 | Arensmeier et al. |
| 2014/0084836 | A1 | 3/2014 | Pham et al. |
| 2014/0229014 | A1 | 8/2014 | Pham et al. |
| 2014/0260342 | A1 | 9/2014 | Pham |
| 2014/0260390 | A1 | 9/2014 | Pham |
| 2014/0262134 | A1 | 9/2014 | Arensmeier et al. |
| 2014/0266755 | A1 | 9/2014 | Arensmeier et al. |
| 2014/0297208 | A1 | 10/2014 | Arensmeier |
| 2014/0299289 | A1 | 10/2014 | Alsaleem et al. |
| 2015/0135748 | A1 | 5/2015 | Alsaleem et al. |
| 2015/0155701 | A1 | 6/2015 | Wallis et al. |
| 2015/0261230 | A1 | 9/2015 | Kates |
| 2015/0367463 | A1 | 12/2015 | Pham |
| 2016/0076536 | A1 | 3/2016 | Jayanth et al. |
| 2016/0223238 | A1 | 8/2016 | Kates |
| 2016/0226416 | A1 | 8/2016 | Pham et al. |

FOREIGN PATENT DOCUMENTS

| | | | |
|---|---|---|---|
| CN | 1169619 | A | 1/1998 |
| CN | 1297522 | A | 5/2001 |
| CN | 1742427 | A | 3/2006 |
| CN | 1922445 | A | 2/2007 |
| CN | 101048713 | A | 10/2007 |
| CN | 101156033 | A | 4/2008 |
| CN | 101270908 | A | 9/2008 |
| CN | 101361244 | A | 2/2009 |
| CN | 101466193 | A | 6/2009 |
| CN | 101506600 | A | 8/2009 |
| CN | 101802521 | A | 8/2010 |
| CN | 101821693 | A | 9/2010 |
| DE | 1403467 | A1 | 10/1969 |
| DE | 3118638 | A1 | 5/1982 |
| DE | 3508353 | A1 | 9/1985 |
| DE | 29723145 | U1 | 4/1998 |
| EP | 0060172 | A1 | 9/1982 |
| EP | 0085246 | A1 | 8/1983 |
| EP | 0351272 | A1 | 1/1990 |
| EP | 0355255 | A2 | 2/1990 |
| EP | 0361394 | A2 | 4/1990 |
| EP | 0453302 | A1 | 10/1991 |
| EP | 0877462 | A2 | 11/1998 |
| EP | 1087184 | A2 | 3/2001 |
| EP | 1245912 | A2 | 10/2002 |
| EP | 1435002 | A1 | 7/2004 |
| EP | 1487077 | A2 | 12/2004 |
| EP | 1541869 | A1 | 6/2005 |
| EP | 2180270 | A1 | 4/2010 |
| FR | 2472862 | A1 | 7/1981 |
| GB | 2062919 | A | 5/1981 |
| GB | 2347217 | A | 8/2000 |
| JP | 63061783 | A | 3/1988 |
| JP | 02110242 | A | 4/1990 |
| JP | 02294580 | A | 12/1990 |
| JP | 06058273 | A | 3/1994 |
| JP | 08021675 | A | 1/1996 |
| JP | H08261541 | A | 10/1996 |
| JP | 2002155868 | A | 5/2002 |
| JP | 2003176788 | A | 6/2003 |
| JP | 2004316504 | A | 11/2004 |
| JP | 2005188790 | A | 7/2005 |
| JP | 2006046219 | A | 2/2006 |
| JP | 2006274807 | A | 10/2006 |
| JP | 2009229184 | A | 10/2009 |
| KR | 1020000000261 | | 1/2000 |
| KR | 1020000025265 | | 5/2000 |
| KR | 1020020041977 | | 6/2002 |
| KR | 20030042857 | A | 6/2003 |
| KR | 1020040021281 | | 3/2004 |
| KR | 1020060020353 | | 3/2006 |
| RU | 30009 | U1 | 6/2003 |
| RU | 55218 | U1 | 7/2006 |
| WO | 8806703 | A1 | 9/1988 |
| WO | 9718636 | A2 | 5/1997 |
| WO | 9917066 | A1 | 4/1999 |
| WO | 9961847 | A1 | 12/1999 |
| WO | 0051223 | A1 | 8/2000 |
| WO | 0169147 | A1 | 9/2001 |
| WO | 0275227 | A1 | 9/2002 |
| WO | WO-03031996 | A1 | 4/2003 |
| WO | 2005108882 | A2 | 11/2005 |
| WO | 2006025880 | A1 | 3/2006 |
| WO | WO-2008010988 | A1 | 1/2008 |
| WO | WO-2008079108 | A1 | 7/2008 |
| WO | 2009058356 | A1 | 5/2009 |
| WO | WO-2012118550 | A1 | 9/2012 |

OTHER PUBLICATIONS

"Manual for Freezing and Air Conditioning Technology," Fan Jili, Liaoning Science and Technology Press, Sep. 1995 (cited in First Office Action issued by the Chinese Patent Office regarding Application No. 200780030810.X dated Dec. 25, 2009).

"Product Performance Introduction of York Company," cited in First Office Action from the Patent Office of the People's Republic

(56) References Cited

OTHER PUBLICATIONS of China dated Jun. 29, 2007 regarding Application No. 200510005907.8, including translation by CCPIT Patent and Trademark Law Office.
"Small-type Freezing and Air Conditioning Operation," Chinese State Economy and Trading Committee, China Meteorological Press, Mar. 2003 (cited in First Office Action issued by the Chinese Patent Office regarding Application No. 200780030810.X dated Dec. 25, 2009).
Advisory Action Before the Filing of an Appeal Brief regarding U.S. Appl. No. 11/098,575, dated Jan. 27, 2010.
Advisory Action Before the Filing of an Appeal Brief regarding U.S. Appl. No. 11/098,575, dated Nov. 16, 2009.
Advisory Action Before the Filing of an Appeal Brief regarding U.S. Appl. No. 11/098,575, dated Sep. 28, 2009.
BChydro, "Power Factor" Guides to Energy Management: The GEM Series, Dec. 2000, 8 Pages.
Building Control Unit (BCU) Installation and Operation Manual, Computer Process Controls, Jan. 28, 1998.
Building Environmental Control (BEC) Installation and Operation Manual, Computer Process Controls, Jan. 5, 1998.
Einstein RX-300 Refrigeration Controller Installation and Operation Manual, Computer Process Controls, Apr. 1, 1998; 329 Pages.
European Search Report for Application No. EP 01 30 1752, dated Mar. 26, 2002, 4 Pages.
European Search Report for Application No. EP 02 25 1531, dated Sep. 30, 2002, 4 Pages.
European Search Report for Application No. EP 04 81 5853, dated Jul. 17, 2007, 2 Pages.
European Search Report for Application No. EP 06 02 6263, dated Jul. 17, 2007, 4 Pages.
Final Office Action mailed Dec. 7, 2010 for U.S. Appl. No. 12/054,011.
Final Office Action regarding U.S. Appl. No. 11/098,575, dated Jun. 17, 2010.
First Office Action from the Patent Office of the People's Republic of China regarding Application No. 200510005907.8, dated Jun. 29, 2007.
First Office Action from the State Intellectual Property Office of the People's Republic of China regarding Chinese Patent Application No. 200890100287.3, issued Oct. 25, 2010. Translation provided by Unitalen Attorneys at Law.
First Office Action issued by the Chinese Patent Office dated Sep. 5, 2008 regarding Application No. 200480015875.3, 59 Pages.
First Office Action issued by the Chinese Patent Office on May 30, 2008 regarding Application No. 200580013451.8, 8 Pages.
First Office Action issued by the Chinese Patent Office regarding Application No. 200780030810.X dated Dec. 25, 2009.
First Office Action regarding Chinese Patent Application No. 200780032977.X, dated Sep. 27, 2010. English translation provided by Unitalen Attorneys at Law.
First Office Action regarding Chinese Patent Application No. 201010117657.8, dated Dec. 29, 2010. English translation provided by Unitalen Attorneys at Law.
International Preliminary Report on Patentability dated Apr. 1, 2010 regarding International Application No. PCT/US2008/009618.
International Preliminary Report on Patentability for International Application No. PCT/US2008/012362, dated May 4, 2010.
International Preliminary Report on Patentability for International Application No. PCT/US2008/012364, dated May 4, 2010.
International Preliminary Report on Patentability regarding International Application No. PCT/US2007/019563 dated Mar. 10, 2009.
International Search Report for International Application No. PCT/US04/43859, dated Mar. 2, 2006, 3 Pages.
International Search Report for International Application No. PCT/US05/11154, dated Oct. 19, 2005, 2 Pages.
International Search Report for International Application No. PCT/US07/019563, dated Jan. 15, 2008, 3 Pages.
International Search Report for International Application No. PCT/US2007/016135 dated Oct. 22, 2007.
International Search Report for International Application No. PCT/US2008/009618 dated Dec. 8, 2008.
International Search Report for International Application No. PCT/US2008/012362, dated Feb. 12, 2009.
International Search Report for International Application No. PCT/US2008/012364 dated Mar. 13, 2009.
Interview Summary regarding U.S. Appl. No. 11/098,582, dated Apr. 27, 2010.
Non-Final Office Action for U.S. Appl. No. 11/098,575 dated Jan. 27, 2010.
Non-Final Office Action mailed Mar. 3, 2011 for U.S. Appl. No. 12/054,011.
Non-Final Office Action mailed Aug. 13, 2010 for U.S. Appl. No. 12/054,011.
Non-Final Office Action regarding U.S. Appl. No. 12/261,643, dated Jan. 27, 2011.
Notice of Allowance and Fees Due and Notice of Allowability regarding U.S. Appl. No. 11/098,582, dated Feb. 24, 2009.
Notice of Allowance and Fees Due and Notice of Allowability regarding U.S. Appl. No. 11/098,582, dated Sep. 24, 2010.
Office Action regarding U.S. Appl. No. 11/098,575, dated Jan. 29, 2009.
Office Action regarding U.S. Appl. No. 11/098,575, dated Mar. 26, 2008.
Office Action regarding U.S. Appl. No. 11/098,575, dated Jul. 13, 2009.
Office Action regarding U.S. Appl. No. 11/098,575, dated Sep. 9, 2008.
Office Action regarding U.S. Appl. No. 11/098,582 dated Mar. 3, 2010.
Office Action regarding U.S. Appl. No. 11/098,582, dated Jul. 7, 2008.
Office Action regarding U.S. Appl. No. 11/098,582, dated Aug. 4, 2009.
Office Action regarding U.S. Appl. No. 11/098,582, dated Sep. 21, 2007.
Office Action regarding U.S. Appl. No. 11/776,879, dated Sep. 17, 2010.
Office Action regarding U.S. Appl. No. 11/850,846, dated Aug. 13, 2010.
Official Action regarding Australian Patent Application No. 2008325240, dated Jan. 19, 2011.
Refrigeration Monitor and Case Control Installation and Operation Manual, Computer Process Controls, Aug. 12, 1999.
Second Office Action issued by the Chinese Patent Office dated Feb. 27, 2009 regarding Application No. 200480015875.3, 17 Pages.
Second Office action issued by the Chinese Patent Office dated Jun. 19, 2009 regarding Application No. 200510005907.8, translation provided by CCPIT Patent and Trademark Law Office.
Second Office Action issued by the Chinese Patent Office on Mar. 6, 2009 regarding Application No. 200580013451.8, 7 Pages.
Second Office Action regarding Chinese Patent Application No. 200890100287.3, dated Jan. 27, 2011. English translation provided by Unitalen Attorneys at Law.
Second Office Action regarding Chinese Patent Appplication No. 200780030810X, dated Aug. 4, 2010. English translation provided by Unitalen Attorneys at Law.
Third Office Action issued by the Chinese Patent Office on Jun. 19, 2009 regarding Application No. 200580013451.8, 5 Pages.
Translation of Claims and Abstract of KR Patent Laying-Open No. 2000-0000261; 4 Pages.
Ultrasite 32 User's Guide, Computer Process Controls, Sep. 28, 1999.
Ultrasite User's Guide BCU Supplement, Computer Process Controls, Sep. 4, 1997.
Ultrasite User's Guide BEC Supplement, Computer Process Controls, Oct. 6, 1997.
Ultrasite User's Guide RMCC Supplement, Computer Process Controls, Jun. 9, 1997.
Written Opinion of the International Searching Authority for International Application No. PCT/US07/019563, dated Jan. 15, 2008, 6 Pages.

(56) References Cited

OTHER PUBLICATIONS

Written Opinion of the International Searching Authority for International Application No. PCT/US2008/009618 dated Dec. 8, 2008.
Written Opinion of the International Searching Authority for International Application No. PCT/US2008/012364 dated Mar. 12, 2009.
Final Office Action for U.S. Appl. No. 12/054,011, dated Jun. 30, 2011.
First Office Action regarding Chinese Application No. 200880106319.5, dated May 25, 2011. English translation provided by Unitalen Attorneys at Law.
Non-Final Office Action for U.S. Appl. No. 12/054,011, dated Oct. 20, 2011.
Non-Final Office Action for U.S. Appl. No. 12/054,011, dated Apr. 10, 2012.
Final Office Action regarding U.S. Appl. No. 12/261,643, dated Jul. 7, 2011.
Office Action regarding U.S. Appl. No. 12/261,643, dated Nov. 2, 2011.
Office Action regarding U.S. Appl. No. 12/261,677, dated Aug. 4, 2011.
Notice of Allowance regarding U.S. Appl. No. 12/261,677, dated Dec. 15, 2011.
Office Action regarding U.S. Appl. No. 12/261,643, dated Feb. 15, 2012.
Examiner's Report No. 2 regarding Australian Patent Application No. 2008325240, dated Mar. 5, 2012.
Non-Final Office Action regarding U.S. Appl. No. 13/176,021, dated May 8, 2012.
Final Office Action regarding U.S. Appl. No. 12/261,643, dated Jun. 27, 2012.
Non-Final Office Action regarding U.S. Appl. No. 11/850,846, dated Apr. 24, 2012.
Advisory Action and Interview Summary regarding U.S. Appl. No. 13/407,180, dated May 27, 2015.
Advisory Action regarding U.S. Appl. No. 13/269,188, dated Apr. 13, 2015.
Advisory Action regarding U.S. Appl. No. 14/080,473, dated Jan. 30, 2017.
Advisory Action regarding U.S. Appl. No. 14/193,568, dated Aug. 10, 2016.
Advisory Action regarding U.S. Appl. No. 14/212,632, dated Feb. 9, 2016.
Advisory Action regarding U.S. Appl. No. 14/212,632, dated Mar. 8, 2016.
Applicant-Initiated Interview Summary and Advisory Action regarding U.S. Appl. No. 13/369,067, dated Jul. 23, 2015.
Applicant-Initiated Interview Summary regarding U.S. Appl. No. 13/770,479, dated Dec. 9, 2016.
Applicant-Initiated Interview Summary regarding U.S. Appl. No. 14/212,632, dated Sep. 2, 2015.
Examiner's Report No. 1 regarding Australian Patent Application No. 2013202431, dated Nov. 25, 2014.
Extended European Search Report regarding European Application No. 08845689.2-1608/2207964, dated Jun. 19, 2015.
Extended European Search Report regarding European Application No. 08848538.8-1608 / 2220372, dated Jun. 19, 2015.
Faramarzi et al., "Performance Evaluation of Rooftop Air Conditioning Units at High Ambient Temperatures," 2004 ACEEE Summer Study on Energy Efficiency in Buildings—http://aceee.org/files/proceedings/2004/data/papers/SSO4_Panel3_Paper05.pdf.
Final Office Action and Interview Summary regarding U.S. Appl. No. 13/407,180, mailed Mar. 13, 2015.
Final Office Action for U.S. Appl. No. 13/770,123 dated Dec. 22, 2014.
Final Office Action regarding U.S. Appl. No. 13/770,479, dated Sep. 4, 2015.
First Chinese Office Action regarding Application No. 201380005300.2, dated Apr. 30, 2015. Translation provided by Unitalen Attorneys at Law.
First Office Action regarding Chinese Patent Application No. 201280010796.8, dated Sep. 14, 2015. Translation provided by Unitalen Attorneys at Law.
Haiad et al., "EER & SEER as Predictors of Seasonal Energy Performance ", Oct. 2004, Southern California Edison, http://www.doe2.com/download/DEER/SEER%2BProgThermostats/EER-SEER_CASE_ProjectSummary_Oct2004_V6a.pdf.
International Search Report and Written Opinion for related PCT Application No. PCT/US2014/028859, dated Aug. 22, 2014.
International Search Report and Written Opinion of the ISA regarding International Application No. PCT/US2014/032927, ISA/KR dated Aug. 21, 2014.
Interview Summary regarding U.S. Appl. No. 12/054,011, dated Jan. 30, 2012.
Interview Summary regarding U.S. Appl. No. 13/269,188, mailed Mar. 18, 2015.
Interview Summary regarding U.S. Appl. No. 13/369,067, dated Jul. 16, 2015.
Interview Summary regarding U.S. Appl. No. 13/407,180, dated Jun. 11, 2015.
Interview Summary regarding U.S. Appl. No. 13/770,479, dated Jun. 16, 2015.
Interview Summary regarding U.S. Appl. No. 13/770,479, dated Nov. 25, 2015.
Interview Summary regarding U.S. Appl. No. 14/209,415, dated Jun. 20, 2016.
Interview Summary regarding U.S. Appl. No. 14/617,451, dated Jul. 28, 2016.
Louis Goodman et al. "Vertical Motion of Neutrally Buoyant Floats." Journal of Atmospheric and Oceanic Technology. vol. 7. Feb. 1990.
Non Final Office Action for U.S. Appl. No. 13/407,180, dated Dec. 2, 2014.
Non-Final Office Action regarding U.S. Appl. No. 13/932,611, dated Jan. 30, 2015.
Notice of Allowance and Fees Due regarding U.S. Appl. No. 13/737,566, dated Sep. 24, 2014.
Notice of Allowance and Interview Summary regarding U.S. Appl. No. 13/269,188, dated Aug. 26, 2015.
Notice of Allowance for U.S. Appl. No. 13/835,742 dated Dec. 24, 2014.
Notice of Allowance for U.S. Appl. No. 13/835,810 date Jan. 2, 2015.
Notice of Allowance for U.S. Appl. No. 13/836,043 dated Feb. 4, 2015.
Notice of Allowance for U.S. Appl. No. 13/836,453 dated Dec. 24, 2014.
Notice of Allowance for related U.S. Appl. No. 13/836,043, dated Oct. 9, 2014.
Notice of Allowance for related U.S. Appl. No. 13/836,244, dated Oct. 30, 2014.
Notice of Allowance regarding U.S. Appl. No. 13/767,479, dated Mar. 31, 2015.
Notice of Allowance regarding U.S. Appl. No. 13/770,123, dated Oct. 1, 2015.
Notice of Allowance regarding U.S. Appl. No. 13/835,621, dated Mar. 10, 2015.
Notice of Allowance regarding U.S. Appl. No. 12/261,643, mailed Jul. 29, 2015.
Notice of Allowance regarding U.S. Appl. No. 13/369,067, dated Sep. 2, 2015.
Notice of Allowance regarding U.S. Appl. No. 13/407,180, dated Sep. 4, 2015.
Notice of Allowance regarding U.S. Appl. No. 13/770,123, dated Aug. 13, 2015.
Notice of Allowance regarding U.S. Appl. No. 13/835,742, mailed Apr. 17, 2015.
Notice of Allowance regarding U.S. Appl. No. 13/836,453, mailed Apr. 15, 2015.
Notice of Allowance regarding U.S. Appl. No. 13/932,611, dated Jul. 6, 2015.
Office Action and Interview Summary regarding U.S. Appl. No. 14/244,967, dated Oct. 7, 2015.

(56) References Cited

OTHER PUBLICATIONS

Office Action for U.S. Appl. No. 13/269,188 dated Feb. 10, 2015.
Office Action for U.S. Appl. No. 13/767,479 dated Feb. 6, 2015.
Office Action for U.S. Appl. No. 13/835,621 dated Dec. 29, 2014.
Office Action for Canadian Application No. 2,828,740 dated Jan. 12, 2015.
Office Action for related U.S. Appl. No. 13/269,188, dated Oct. 6, 2014.
Office Action for related U.S. Appl. No. 13/767,479, dated Oct. 21, 2014.
Office Action from U.S. Appl. No. 13/369,067 dated Apr. 3, 2015.
Office Action regarding U.S. Appl. No. 13/770,479, mailed Mar. 16, 2015.
Office Action regarding U.S. Appl. No. 13/770,123, mailed Apr. 2, 2015.
Office Action regarding Australian Patent Application No. 2013323760, dated Sep. 25, 2015.
Office Action regarding Australian Patent Application No. 2014229103, dated Apr. 28, 2016.
Office Action regarding Australian Patent Application No. 2015207920, dated Dec. 4, 2015.
Office Action regarding Australian Patent Application No. 2015255255, dated Sep. 8, 2016.
Office Action regarding Canadian Patent Application No. 2,904,734, dated Sep. 13, 2016.
Office Action regarding Canadian Patent Application No. 2,908,362, dated Sep. 21, 2016.
Office Action regarding Chinese Patent Application No. 201380005300.2, dated Jan. 4, 2016. Translation provided by Unitalen Attorneys at Law.
Office Action regarding Chinese Patent Application No. 201380049458.X, dated Nov. 13, 2015. Translation provided by Unitalen Attorneys at Law.
Office Action regarding Chinese Patent Application No. 201480016023.X, dated Jun. 22, 2016. Translation provided by Unitalen Attorneys at Law.
Office Action regarding European Patent Application No. 08848538.8-1608, dated Feb. 3, 2016.
Office Action regarding Indian Patent Application No. 733/KOLNP/2009, dated Aug. 12, 2015.
Office Action regarding U.S. Appl. No. 12/943,626, dated May 4, 2016.
Office Action regarding U.S. Appl. No. 12/943,626, dated Nov. 4, 2016.
Office Action regarding U.S. Appl. No. 13/770,479, dated Sep. 7, 2016.
Office Action regarding U.S. Appl. No. 14/080,473, dated Jun. 6, 2016.
Office Action regarding U.S. Appl. No. 14/080,473, dated Nov. 16, 2016.
Office Action regarding U.S. Appl. No. 14/193,568, dated Jun. 1, 2016.
Office Action regarding U.S. Appl. No. 14/193,568, dated Nov. 3, 2015.
Office Action regarding U.S. Appl. No. 14/208,636, dated Aug. 4, 2016.
Office Action regarding U.S. Appl. No. 14/208,636, dated Jan. 26, 2017.
Office Action regarding U.S. Appl. No. 14/209,415, dated Mar. 10, 2016.
Office Action regarding U.S. Appl. No. 14/209,415, dated Sep. 10, 2015.
Office Action regarding U.S. Appl. No. 14/212,632, dated Apr. 7, 2016.
Office Action regarding U.S. Appl. No. 14/212,632, dated Nov. 19, 2015.
Office Action regarding U.S. Appl. No. 14/244,967, dated Aug. 29, 2016.
Office Action regarding U.S. Appl. No. 14/244,967, dated Feb. 12, 2016.
Office Action regarding U.S. Appl. No. 14/244,967, dated Jan. 20, 2017.
Office Action regarding U.S. Appl. No. 14/255,519, dated Nov. 9, 2015.
Office Action regarding U.S. Appl. No. 14/255,519, dated Oct. 5, 2016.
Office Action regarding U.S. Appl. No. 14/300,782, dated Sep. 30, 2016.
Office Action regarding U.S. Appl. No. 14/617,451, dated Jun. 2, 2016.
Office Action regarding U.S. Appl. No. 14/727,756, dated Aug. 22, 2016.
Office Action regarding U.S. Appl. No. 15/096,196, dated Sep. 13, 2016.
Patent Examination Report for Austrialian Application No. 2012223466 dated Jan. 6, 2015.
Restriction Requirement regarding U.S. Appl. No. 14/244,967, dated Jul. 14, 2015.
Search Report regarding European Patent Application No. 08251185.8-1605 / 2040016, dated Dec. 4, 2015.
Search Report regarding European Patent Application No. 13736303.2-1806, dated Sep. 17, 2015.
Search Report regarding European Patent Application No. 13841699.5, dated Jun. 30, 2016.
Search Report regarding European Patent Application No. 14763232.7, dated Oct. 27, 2016.
Search Report regarding European Patent Application No. 14764311.8, dated Oct. 27, 2016.
Search Report regarding European Patent Application No. 14780284.7, dated Nov. 2, 2016.
Search Report regarding European Patent Application No. 16187893.9, dated Jan. 19, 2017.
Second Office Action from the State Intellectual Property Office of People's Republic of China regarding Chinese Patent Application No. 201110349785.X, dated Jul. 25, 2014. Translation provided by Unitalen Attorneys at Law.
Third Chinese Office Action regarding Application No. 201110349785.X, dated Jan. 30, 2015. Translation provided by Unitalen Attorneys at Law.
U.S. Office Action regarding U.S. Appl. No. 13/269,188, dated May 8, 2015.
U.S. Office Action regarding U.S. Appl. No. 14/212,632, dated May 15, 2015.

* cited by examiner

REFRIGERATION MONITORING SYSTEM AND METHOD

CROSS-REFERENCE TO RELATED APPLICATIONS

This application is a continuation of U.S. patent application Ser. No. 12/054,011 filed on Mar. 24, 2008. This application claims the benefit of U.S. Provisional Application No. 60/973,583 filed on Sep. 19, 2007. The disclosures of the above applications are incorporated herein by reference.

FIELD

The present disclosure relates to compressors, and more particularly, to a diagnostic system for use with a compressor.

BACKGROUND

The statements in this section merely provide background information related to the present disclosure and may not constitute prior art.

Compressors are used in a wide variety of industrial and residential applications to circulate refrigerant within a refrigeration, heat pump, HVAC, or chiller system (generically referred to as "refrigeration systems") to provide a desired heating and/or cooling effect. In any of the foregoing systems, the compressor should provide consistent and efficient operation to ensure that the particular refrigeration system functions properly.

Refrigeration systems and associated compressors may include a protection system that selectively restricts power to the compressor to prevent operation of the compressor and associated components of the refrigeration system (i.e., evaporator, condenser, etc.) when conditions are unfavorable. The types of faults that may cause protection concerns include electrical, mechanical, and system faults. Electrical faults typically have a direct effect on an electrical motor associated with the compressor, while mechanical faults generally include faulty bearings or broken parts. Mechanical faults often raise a temperature of working components within the compressor and, thus, may cause malfunction of and possible damage to the compressor.

In addition to electrical and mechanical faults associated with the compressor, the compressor and refrigeration system components may be affected by system faults attributed to system conditions such as an adverse level of fluids (i.e., refrigerant) disposed within the system or a blocked-flow condition external to the compressor. Such system conditions may raise an internal compressor temperature or pressure to high levels, thereby damaging the compressor and causing system inefficiencies and/or failures.

Conventional protection systems typically sense temperature and/or pressure parameters as discrete switches and interrupt power supplied to the electrical motor of the compressor should a predetermined temperature or pressure threshold be exceeded. While such sensors provide an accurate indication of pressure or temperature within the refrigeration system and/or compressor, such sensors must be placed at numerous locations within the system and/or compressor, thereby increasing the complexity and cost of the refrigeration system and compressor.

Even when multiple sensors are employed, such sensors do not account for variability in manufacturing of the compressor or refrigeration system components. Furthermore, placement of such sensors within the refrigeration system are susceptible to changes in the volume of refrigerant disposed within the refrigeration system (i.e., change of the refrigeration system). Because such sensors are susceptible to changes in the volume of refrigerant disposed within the refrigeration system, such temperature and pressure sensors do not provide an accurate indication of temperature or pressure of the refrigerant when the refrigeration system and compressor experience a severe undercharge condition (i.e., a low-refrigerant condition) or a severe overcharge condition (i.e., a high-refrigerant condition).

SUMMARY

A system is provided and may include a refrigeration circuit having a condenser, a first sensor producing a signal indicative of a detected condenser temperature of the condenser, and processing circuitry in communication with the first sensor. The processing circuitry may determine a derived condenser temperature independent from information received from the first sensor and may compare the derived condenser temperature to the detected condenser temperature to determine a charge level of the refrigeration circuit.

A method is provided and may include detecting by a first sensor a temperature of a condenser, communicating the detected condenser temperature to processing circuitry, and deriving by the processing circuitry a temperature of the condenser based on information independent from information received from the first sensor. The method may also include comparing by the processing circuitry the derived condenser temperature with the detected condenser temperature and determining one of an overcharge condition, an undercharge condition, and an adequate-charge condition based on the comparing.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

DETAILED DESCRIPTION

Figure 1:
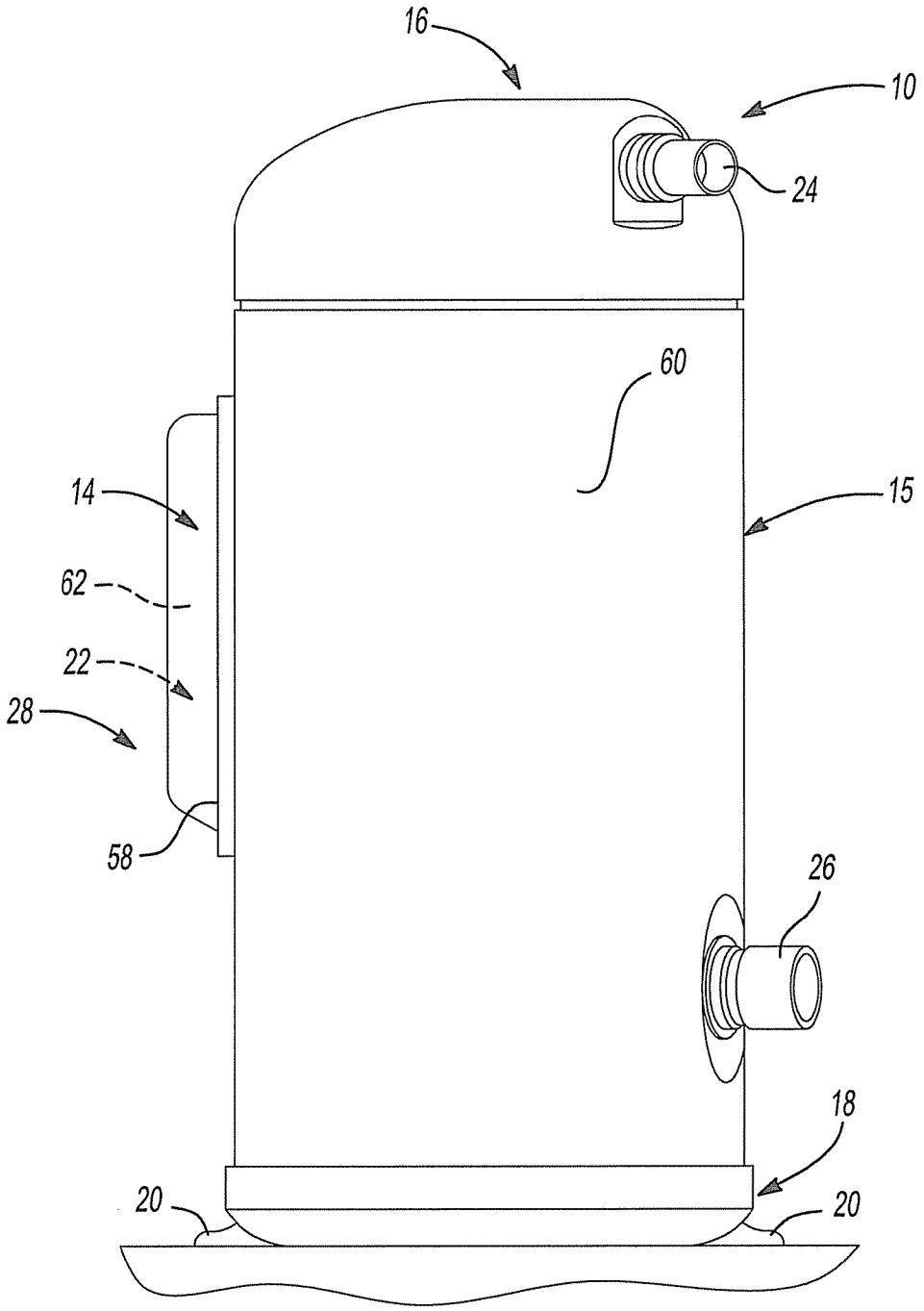
FIG. 1 is a perspective view of a compressor incorporating a protection and control system in accordance with the principles of the present teachings.

The following description is merely exemplary in nature and is not intended to limit the present disclosure, application, or uses. It should be understood that throughout the drawings, corresponding reference numerals indicate like or corresponding parts and features.

With reference to the drawings, a compressor 10 is shown incorporated into a refrigeration system 12. A protection and control system 14 is associated with the compressor 10 and the refrigeration system 12 to monitor, control, protect, and/or diagnose the compressor 10 and/or the refrigeration system 12. The protection and control system 14 utilizes a series of sensors to determine non-measured operating parameters of the compressor 10 and/or refrigeration system 12 and uses the non-measured operating parameters in conjunction with measured operating parameters from the sensors to monitor, control, protect, and/or diagnose the compressor 10 and/or refrigeration system 12. Such non-measured operating parameters may also be used to check the sensors to validate the measured operating parameters and to determine a refrigerant charge level of the refrigeration system 12.

Figure 2:
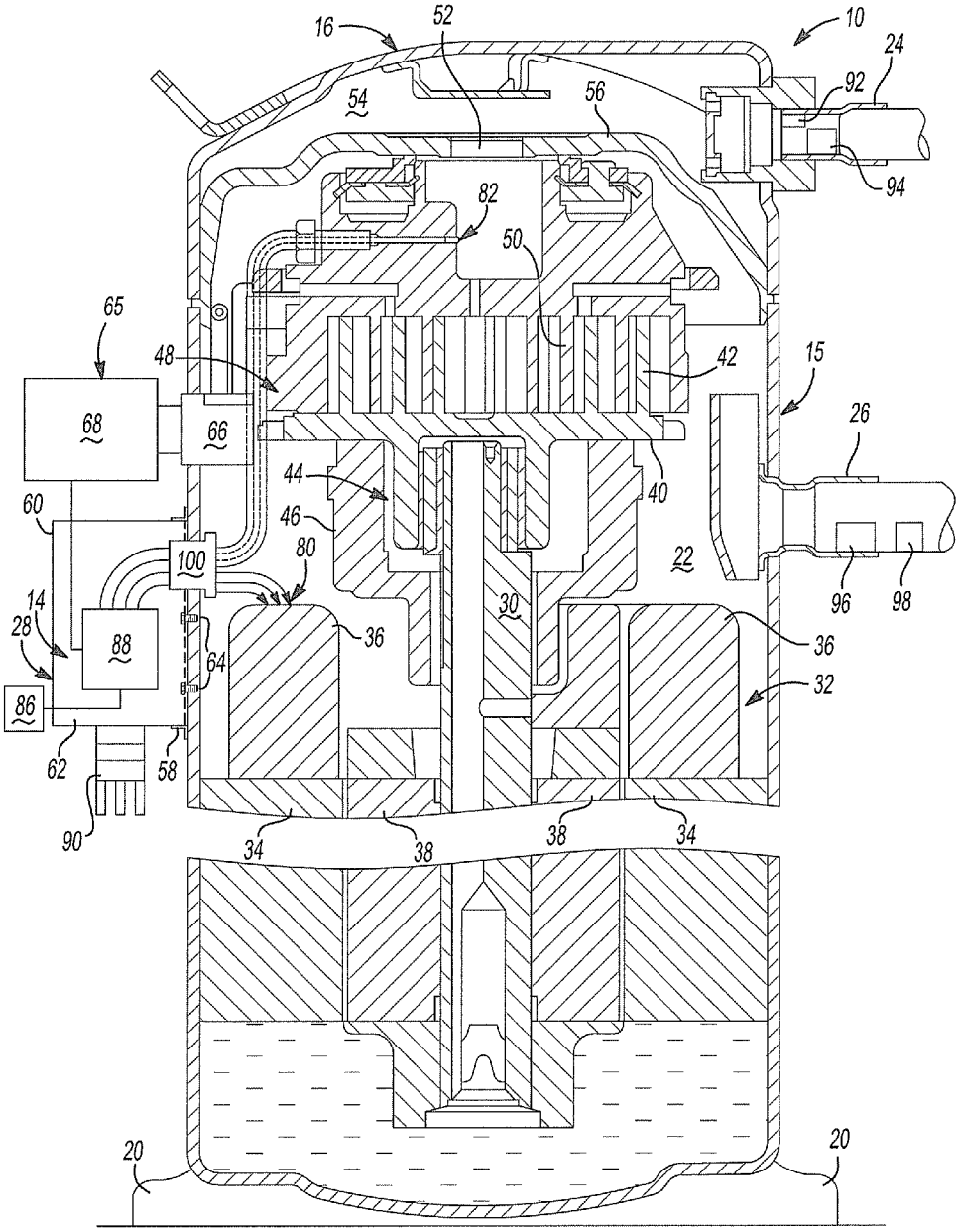
FIG. 2 is a cross-sectional view of the compressor of FIG. 1.

With particular reference to FIGS. 1 and 2, the compressor 10 is shown to include a generally cylindrical hermetic shell 15 having a welded cap 16 at a top portion and a base 18 having a plurality of feet 20 welded at a bottom portion. The cap 16 and the base 18 are fitted to the shell 15 such that an interior volume 22 of the compressor 10 is defined. The cap 16 is provided with a discharge fitting 24, while the shell 15 is similarly provided with an inlet fitting 26, disposed generally between the cap 16 and base 18, as best shown in FIG. 2. An electrical enclosure 28 is attached to the shell 15 generally between the cap 16 and the base 18 and may support a portion of the protection and control system 14 therein.

A crankshaft 30 is rotatably driven by an electric motor 32 relative to the shell 15. The motor 32 includes a stator 34 fixedly supported by the hermetic shell 15, windings 36 passing therethrough, and a rotor 38 press-fit on the crankshaft 30. The motor 32 and associated stator 34, windings 36, and rotor 38 cooperate to drive the crankshaft 30 relative to the shell 15 to compress a fluid.

The compressor 10 further includes an orbiting scroll member 40 having a spiral vein or wrap 42 on an upper surface thereof for use in receiving and compressing a fluid. An Oldham coupling 44 is disposed generally between the orbiting scroll member 40 and a bearing housing 46 and is keyed to the orbiting scroll member 40 and a non-orbiting scroll member 48. The Oldham coupling 44 transmits rotational forces from the crankshaft 30 to the orbiting scroll member 40 to compress a fluid disposed generally between the orbiting scroll member 40 and the non-orbiting scroll member 48. Oldham coupling 44, and its interaction with orbiting scroll member 40 and non-orbiting scroll member 48, is preferably of the type disclosed in assignee's commonly owned U.S. Pat. No. 5,320,506, the disclosure of which is incorporated herein by reference.

The non-orbiting scroll member 48 also includes a wrap 50 positioned in meshing engagement with the wrap 42 of the orbiting scroll member 40. The non-orbiting scroll member 48 has a centrally disposed discharge passage 52, which communicates with an upwardly open recess 54. The recess 54 is in fluid communication with the discharge fitting 24 defined by the cap 16 and a partition 56, such that compressed fluid exits the shell 15 via discharge passage 52, recess 54, and fitting 24. The non-orbiting scroll member 48 is designed to be mounted to the bearing housing 46 in a suitable manner such as disclosed in assignee's commonly owned U.S. Pat. Nos. 4,877,382 and 5,102,316, the disclosures of which are incorporated herein by reference.

The electrical enclosure 28 includes a lower housing 58, an upper housing 60, and a cavity 62. The lower housing 58 is mounted to the shell 15 using a plurality of studs 64, which are welded or otherwise fixedly attached to the shell 15. The upper housing 60 is matingly received by the lower housing 58 and defines the cavity 62 therebetween. The cavity 62 is positioned on the shell 15 of the compressor 10 and may be used to house respective components of the protection and control system 14 and/or other hardware used to control operation of the compressor 10 and/or refrigeration system 12.

With particular reference to FIG. 2, the compressor 10 may include an actuation assembly 65 that selectively separates the orbiting scroll member 40 from the non-orbiting scroll member 48 to modulate a capacity of the compressor 10 between a reduced-capacity mode and a full-capacity mode. The actuation assembly 65 may include a solenoid 66 connected to the orbiting scroll member 40 and a controller 68 coupled to the solenoid 66 for controlling movement of the solenoid 66 between an extended position and a retracted position.

Movement of the solenoid 66 into the extended position separates the wraps 42 of the orbiting scroll member 40 from the wraps 50 of the non-orbiting scroll member 48 to reduce an output of the compressor 10. Conversely, movement of the solenoid 66 into the retracted position moves the wraps 42 of the orbiting scroll member 40 closer to the wraps 50 of the non-orbiting scroll member 48 to increase an output of the compressor. In this manner, the capacity of the compressor 10 may be modulated in accordance with demand or in response to a fault condition. While movement of the solenoid 66 into the extended position is described as separating the wraps 42 of the orbiting scroll member 40 from the wraps 50 of the non-orbiting scroll member 48, movement of the solenoid 66 into the extended position could alternately move the wraps 42 of the orbiting scroll member 40 into engagement with the wraps 50 of the non-orbiting scroll member 48. Similarly, while movement of the solenoid 66 into the retracted position is described as moving the wraps 42 of the orbiting scroll member 40 closer to the wraps 50 of the non-orbiting scroll member 48, movement of the solenoid 66 into the retracted position could alternately move the wraps 42 of the orbiting scroll member 40 away from the wraps 50 of the non-orbiting scroll member 48. The actuation assembly 65 may be of the type disclosed in assignee's commonly owned U.S. Pat. No. 6,412,293, the disclosure of which is incorporated herein by reference.

Figure 3:
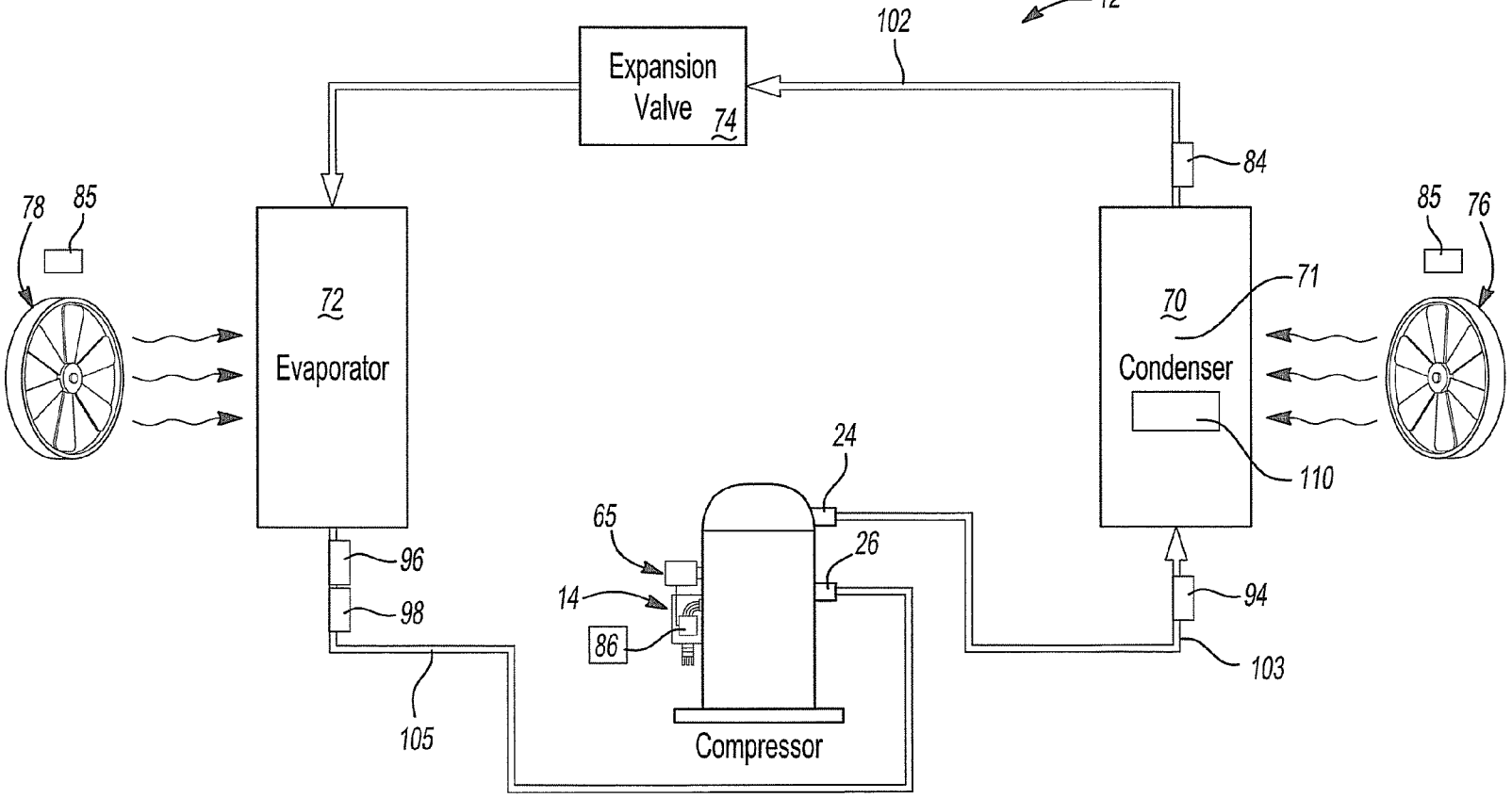
FIG. 3 is a schematic representation of a refrigeration system incorporating the compressor of FIG. 1.

With particular reference to FIG. 3, the refrigeration system 12 is shown to include a condenser 70, an evaporator 72, and an expansion device 74 disposed generally between the condenser 70 and the evaporator 72. The refrigeration system 12 may also include a condenser fan 76 associated with the condenser 70 and an evaporator fan 78 associated with the evaporator 72. Each of the condenser fan 76 and the evaporator fan 78 may be variable-speed fans that can be controlled based on a cooling and/or heating demand of the refrigeration system 12. Furthermore, each of the condenser fan 76 and evaporator fan 78 may be controlled by the protection and control system 14 such that operation of the condenser fan 76 and evaporator fan 78 may be coordinated with operation of the compressor 10.

In operation, the compressor 10 circulates refrigerant generally between the condenser 70 and evaporator 72 to produce a desired heating and/or cooling effect. The compressor 10 receives vapor refrigerant from the evaporator 72 generally at the inlet fitting 26 and compresses the vapor refrigerant between the orbiting scroll member 40 and the non-orbiting scroll member 48 to deliver vapor refrigerant at discharge pressure at discharge fitting 24.

Once the compressor 10 has sufficiently compressed the vapor refrigerant to discharge pressure, the discharge-pressure refrigerant exits the compressor 10 at the discharge fitting 24 and travels within the refrigeration system 12 to the condenser 70. Once the vapor enters the condenser 70, the refrigerant changes phase from a vapor to a liquid, thereby rejecting heat. The rejected heat is removed from the condenser 70 through circulation of air through the condenser 70 by the condenser fan 76. When the refrigerant has sufficiently changed phase from a vapor to a liquid, the refrigerant exits the condenser 70 and travels within the refrigeration system 12 generally towards the expansion device 74 and evaporator 72.

Upon exiting the condenser 70, the refrigerant first encounters the expansion device 74. Once the expansion device 74 has sufficiently expanded the liquid refrigerant, the liquid refrigerant enters the evaporator 72 to change phase from a liquid to a vapor. Once disposed within the evaporator 72, the liquid refrigerant absorbs heat, thereby changing from a liquid to a vapor and producing a cooling effect. If the evaporator 72 is disposed within an interior of a building, the desired cooling effect is circulated into the building to cool the building by the evaporator fan 78. If the evaporator 72 is associated with a heat-pump refrigeration system, the evaporator 72 may be located remote from the building such that the cooling effect is lost to the atmosphere and the rejected heat experienced by the condenser 70 is directed to the interior of the building to heat the building. In either configuration, once the refrigerant has sufficiently changed phase from a liquid to a vapor, the vaporized refrigerant is received by the inlet fitting 26 of the compressor 10 to begin the cycle anew.

With particular reference to FIGS. 2 and 3, the protection and control system 14 is shown to include a high-side sensor 80, a low-side sensor 82, a liquid-line temperature sensor 84, and an outdoor/ambient temperature sensor 86. The protection and control system 14 also includes processing circuitry 88 and a power-interruption system 90, each of which may be disposed within the electrical enclosure 28 mounted to the shell 15 of the compressor 10. The sensors 80, 82, 84, 86 cooperate to provide the processing circuitry 88 with sensor data for use by the processing circuitry 88 in determining non-measured operating parameters of the compressor 10 and/or refrigeration system 12. The processing circuitry 88 uses the sensor data and the determined non-measured operating parameters to diagnose the compressor 10 and/or refrigeration system 12 and selectively restricts power to the electric motor of the compressor 10 via the power-interruption system 90, depending on the identified fault. The protection and control system 14 is preferably of the type disclosed in assignee's commonly owned U.S. patent application Ser. No. 11/776,879 filed Jul. 12, 2007, the disclosure of which is herein incorporated by reference.

The high-side sensor 80 generally provides diagnostics related to high-side faults such as compressor mechanical failures, motor failures, and electrical component failures such as missing phase, reverse phase, motor winding current imbalance, open circuit, low voltage, locked rotor current, excessive motor winding temperature, welded or open contactors, and short cycling. The high-side sensor 80 may be a current sensor that monitors compressor current and voltage to determine and differentiate between mechanical failures, motor failures, and electrical component failures. The high-side sensor 80 may be mounted within the electrical enclosure 28 or may alternatively be incorporated inside the shell 15 of the compressor 10 (FIG. 2). In either case, the high-side sensor 80 monitors current drawn by the compressor 10 and generates a signal indicative thereof, such as disclosed in assignee's commonly owned U.S. Pat. No. 6,615,594, U.S. patent application Ser. No. 11/027,757 filed on Dec. 30, 2004 and U.S. patent application Ser. No. 11/059,646 filed on Feb. 16, 2005, the disclosures of which are incorporated herein by reference.

While the high-side sensor 80 as described herein may provide compressor current information, the protection and control system 14 may also include a discharge pressure sensor 92 mounted in a discharge pressure zone and/or a temperature sensor 94 mounted within or near the compressor shell 15 such as within the discharge fitting 24 (FIG. 2). The temperature sensor 94 may additionally or alternatively be positioned external of the compressor 10 along a conduit 103 extending generally between the compressor 10 and the condenser 70 (FIG. 3) and may be disposed in close proximity to an inlet of the condenser 70. Any or all of the foregoing sensors may be used in conjunction with the high-side sensor 80 to provide the protection and control system 14 with additional system information.

The low-side sensor 82 generally provides diagnostics related to low-side faults such as a low charge in the refrigerant, a plugged orifice, an evaporator fan failure, or a leak in the compressor 10. The low-side sensor 82 may be disposed proximate to the discharge fitting 24 or the discharge passage 52 of the compressor 10 and monitors a discharge-line temperature of a compressed fluid exiting the compressor 10. In addition to the foregoing, the low-side sensor 82 may be disposed external from the compressor shell 15 and proximate to the discharge fitting 24 such that vapor at discharge pressure encounters the low-side sensor 82. Locating the low-side sensor 82 external of the shell 15 allows flexibility in compressor and system design by providing the low-side sensor 82 with the ability to be readily adapted for use with practically any compressor and any system.

While the low-side sensor 82 may provide discharge-line temperature information, the protection and control system 14 may also include a suction pressure sensor 96 or a low-side temperature sensor 98, which may be mounted proximate to an inlet of the compressor 10 such as the inlet fitting 26 (FIG. 2). The suction pressure sensor 96 and low-side temperature sensor 98 may additionally or alternatively be disposed along a conduit 105 extending generally between the evaporator 72 and the compressor 10 (FIG. 3) and may be disposed in close proximity to an outlet of the evaporator 72. Any or all of the foregoing sensors may be used in conjunction with the low-side sensor 82 to provide the protection and control system 14 with additional system information.

While the low-side sensor 82 may be positioned external to the shell 15 of the compressor 10, the discharge temperature of the compressor 10 can similarly be measured within the shell 15 of the compressor 10. A discharge core temperature, taken generally at the discharge fitting 24, could be used in place of the discharge-line temperature arrangement shown in FIG. 2. A hermetic terminal assembly 100 may be used with such an internal discharge temperature sensor to maintain the sealed nature of the compressor shell 15.

The liquid-line temperature sensor 84 may be positioned either within the condenser 70 proximate to an outlet of the condenser 70 or positioned along a conduit 102 extending generally between an outlet of the condenser 70 and the expansion device 74. In this position, the liquid-line temperature sensor 84 is located in a position within the refrigeration system 12 that represents a liquid location that is common to both a cooling mode and a heating mode if the refrigeration system 12 is a heat pump.

Because the liquid-line temperature sensor 84 is disposed generally near an outlet of the condenser 70 or along the conduit 102 extending generally between the outlet of the condenser 70 and the expansion device 74, the liquid-line temperature sensor 84 encounters liquid refrigerant (i.e., after the refrigerant has changed from a vapor to a liquid within the condenser 70) and provides an indication of a temperature of the liquid refrigerant to the processing circuitry 88. While the liquid-line temperature sensor 84 is described as being near an outlet of the condenser 70 or along a conduit 102 extending between the condenser 70 and the expansion device 74, the liquid-line temperature sensor 84 may also be placed anywhere within the refrigeration system 12 that would allow the liquid-line temperature sensor 84 to provide an indication of a temperature of liquid refrigerant within the refrigeration system 12 to the processing circuitry 88.

The ambient temperature sensor or outdoor/ambient temperature sensor 86 may be located external from the compressor shell 15 and generally provides an indication of the outdoor/ambient temperature surrounding the compressor 10 and/or refrigeration system 12. The outdoor/ambient temperature sensor 86 may be positioned adjacent to the compressor shell 15 such that the outdoor/ambient temperature sensor 86 is in close proximity to the processing circuitry 88 (FIG. 2). Placing the outdoor/ambient temperature sensor 86 in close proximity to the compressor shell 15 provides the processing circuitry 88 with a measure of the temperature generally adjacent to the compressor 10. Locating the outdoor/ambient temperature sensor 86 in close proximity to the compressor shell 15 not only provides the processing circuitry 88 with an accurate measure of the surrounding air around the compressor 10, but also allows the outdoor/ambient temperature sensor 86 to be attached to or within the electrical enclosure 28.

The processing circuitry 88 receives sensor data from the high-side sensor 80, low-side sensor 82, liquid-line temperature sensor 84, and outdoor/ambient temperature sensor 86 for use in controlling and diagnosing the compressor 10 and/or refrigeration system 12. The processing circuitry 88 may additionally use the sensor data from the respective sensors 80, 82, 84, 86 to determine non-measured operating parameters of the compressor 10 and/or refrigeration system 12 using the relationships shown in FIGS. 4 and 5.

The processing circuitry 88 determines the non-measured operating parameters of the compressor 10 and/or refrigeration system 12 based on the sensor data received from the respective sensors 80, 82, 84, 86 without requiring individual sensors for each of the non-measured operating parameters. The processing circuitry 88 is able to determine a condenser temperature ($T_{cond}$), subcooling of the refrigeration system 12, a temperature difference between the condenser temperature and outdoor/ambient temperature (TD), and a discharge superheat of the refrigeration system 12, as disclosed in assignee's commonly owned U.S. patent application Ser. No. 11/776,879 filed Jul. 12, 2007, the disclosure of which is herein incorporated by reference.

Figure 4:
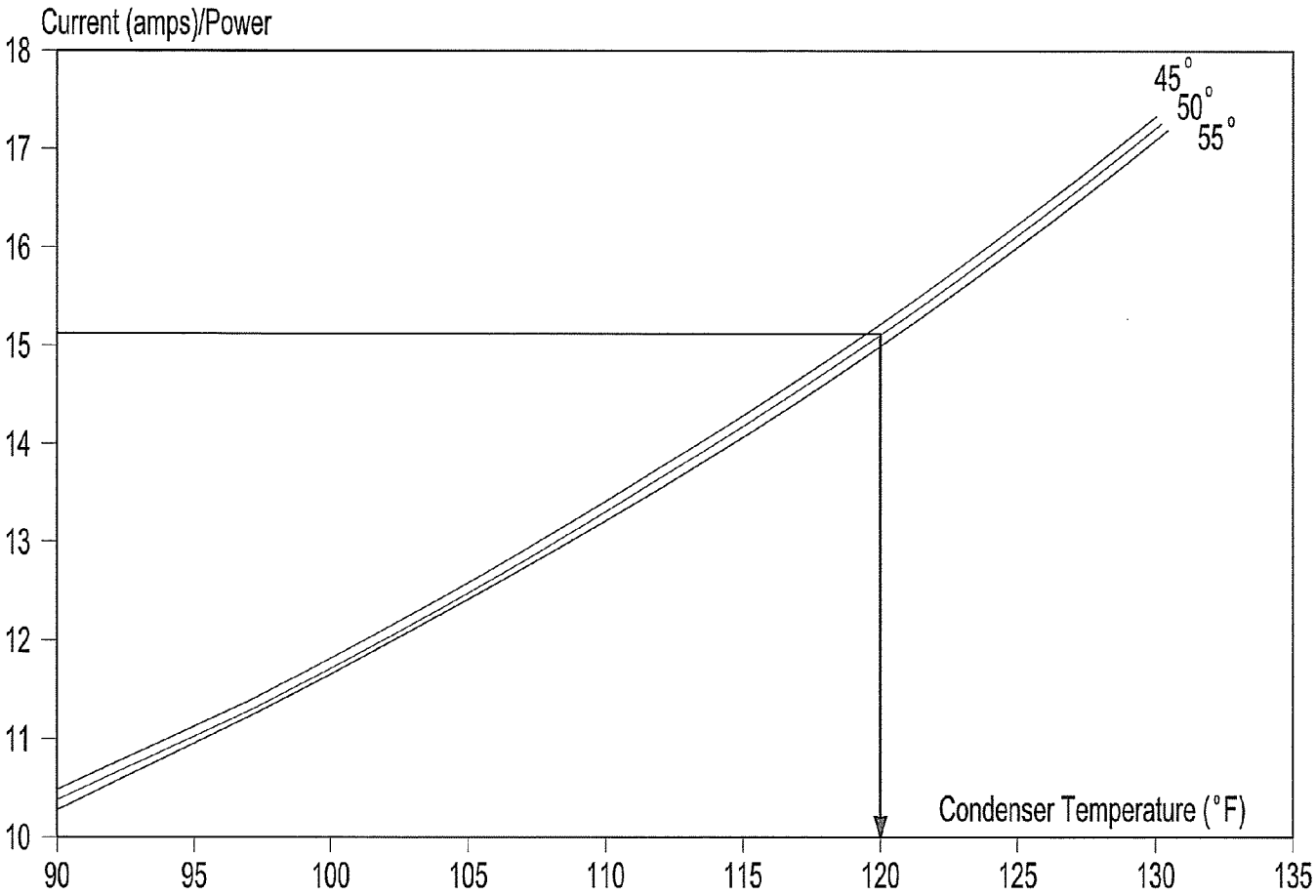
FIG. 4 is a graph of current drawn by a compressor versus condenser temperature for use in determining condenser temperature at a given evaporator temperature.

The processing circuitry 88 may determine the condenser temperature by referencing compressor power or current on a compressor map (FIG. 4). The derived condenser temperature is generally the saturated condenser temperature equivalent to the discharge pressure for a particular refrigerant and should be close to a temperature at a mid-point of the condenser 70.

A compressor map is provided in FIG. 4 showing compressor current versus condenser temperature at various evaporator temperatures ($T_{evap}$). As shown, current remains fairly constant irrespective of evaporator temperature. Therefore, while an exact evaporator temperature can be determined by a second-degree polynomial (i.e., a quadratic function), for purposes of control, the evaporator temperature can be determined by a first-degree polynomial (i.e., a linear function) and can be approximated as roughly 45, 50, or 55 degrees Fahrenheit. The error associated with choosing an incorrect evaporator temperature is minimal when determining the condenser temperature. While compressor current is shown, compressor power and/or voltage may be used in place of current for use in determining condenser temperature. Compressor power may be determined based on the voltage and current drawn by motor 32, as indicated by the high-side sensor 80.

If compressor power is used to determine the determined condenser temperature, compressor power may be determined by integrating the product of voltage and current over a predetermined number of electrical line cycles. For example, the processing circuitry 88 may determine compressor power by taking a reading of voltage and current every half millisecond (i.e., every 0.5 millisecond) during an electrical cycle. If an electrical cycle includes 16 milliseconds, 32 data points are taken per electrical cycle. In one configuration, the processing circuitry 88 may integrate the product of voltage and current over three electrical cycles such that a total of 96 readings (i.e., 3 cycles at 32 data points per cycle) are taken for use in determining the determined condenser temperature.

Figure 5:
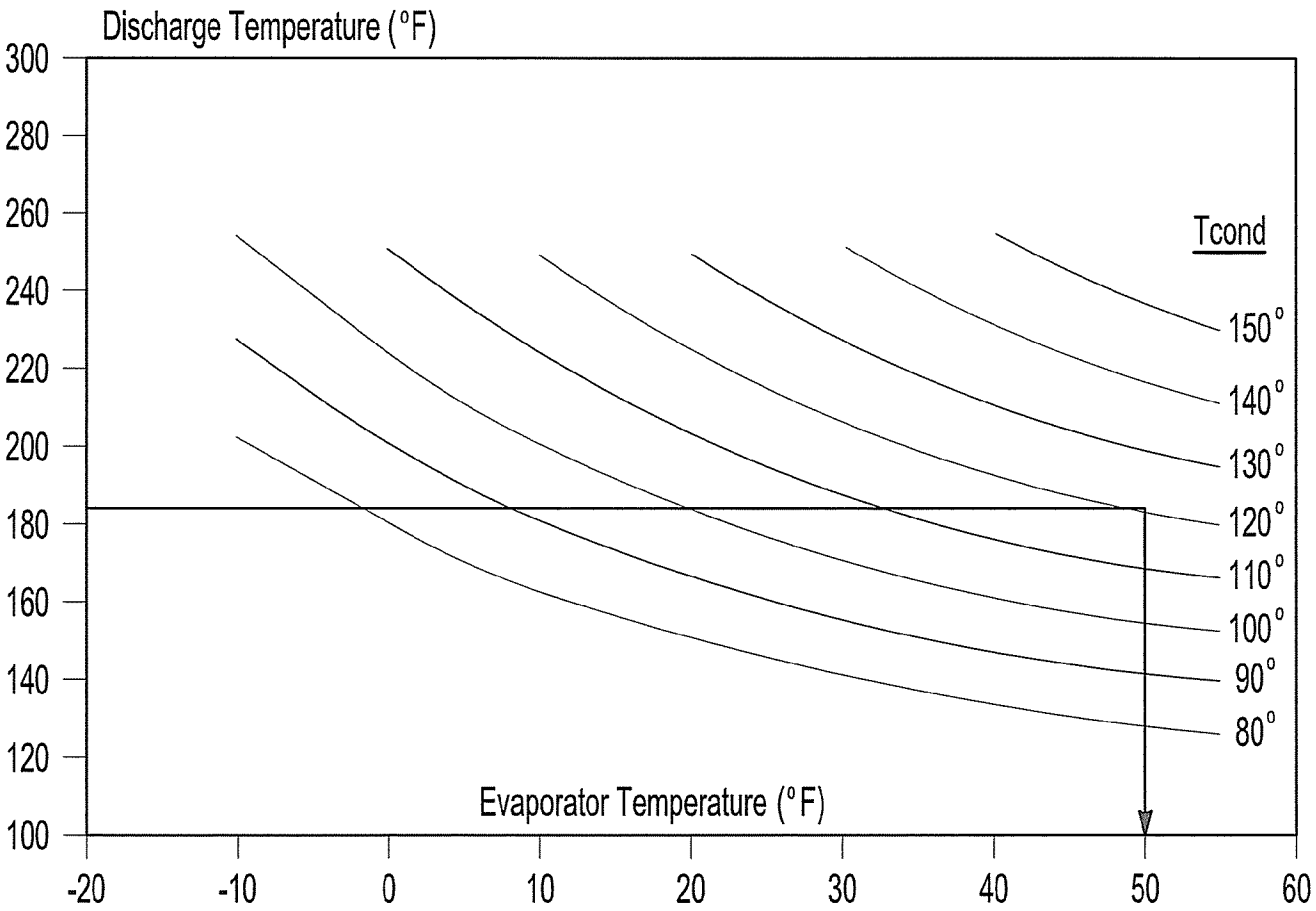
FIG. 5 is a graph of discharge temperature versus evaporator temperature for use in determining an evaporator temperature at a given condenser temperature.
Figure 6:
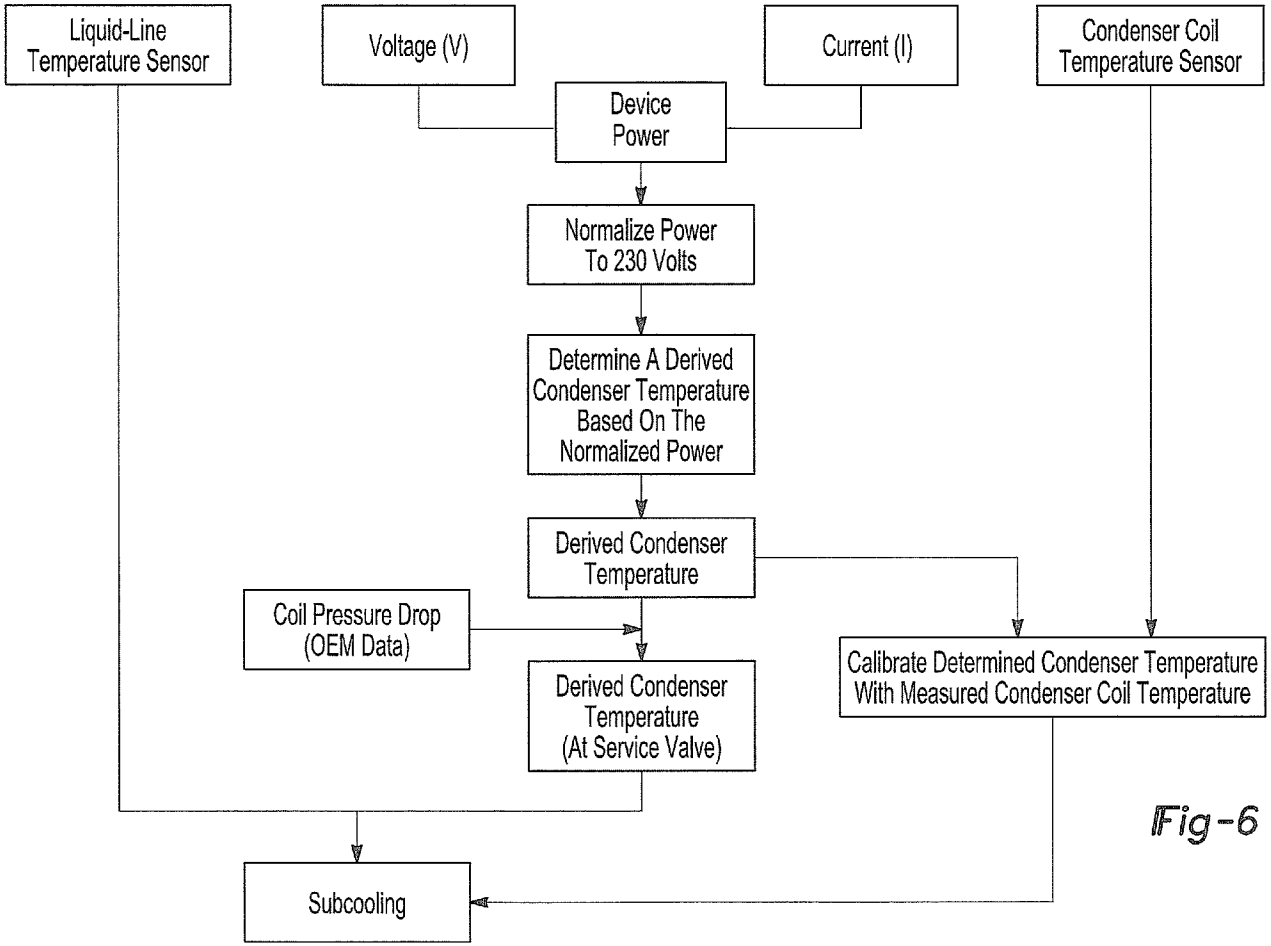
FIG. 6 is a flowchart of a protection and control system in accordance with the principles of the present teachings.

Once the compressor current (or power) is known and is adjusted for voltage based on a baseline voltage contained in a compressor map (FIG. 4), the condenser temperature may be determined by comparing compressor current with condenser temperature using the compressor map of FIG. 4. The evaporator temperature may then be determined by referencing the derived condenser temperature on another compressor map (FIG. 5). The above process for determining the condenser temperature and evaporator temperature is described in assignee's commonly-owned U.S. patent application Ser. No. 11/059,646 filed on Feb. 16, 2005 and assignee's commonly owned U.S. patent application Ser. No. 11/776,879 filed Jul. 12, 2007, the disclosures of which are herein incorporated by reference.

Once the condenser temperature is derived, the processing circuitry 88 is then able to determine the subcooling of the refrigeration system 12 by subtracting the liquid-line temperature, as indicated by the liquid-line temperature sensor 84, from the derived condenser temperature and then subtracting an additional small value (typically 2-3° Fareinheit) representing the pressure drop between an outlet of the compressor 10 and an outlet of the condenser 70. The processing circuitry 88 is therefore able to determine not only the condenser temperature but also the subcooling of the refrigeration system 12 without requiring an additional temperature sensor for either operating parameter.

While the above method determines a temperature of the condenser 70 without requiring an additional temperature sensor, the above method may not accurately produce the actual temperature of the condenser. Due to compressor and system variability (i.e., variability due to manufacturing, for example), the temperature of the condenser 70, as derived using the compressor map of FIG. 4, may not provide the actual temperature of the condenser 70. For example, while the data received by the processing circuitry 88 regarding voltage and current is accurate, the map on which the current is referenced (FIG. 4) to determine the derived condenser temperature may not represent the actual performance of the compressor 10. For example, while the map shown in FIG. 4 may be accurate for most compressors 10, the map may not be accurate for compressors that are manufactured outside of manufacturing specifications. Furthermore, such maps may be slightly inaccurate if changes in the design of the compressor 10 are not similarly incorporated into the compressor map. Finally, if the voltage in the field (i.e., the house voltage) differs from the standard 230 volts from the compressor map, the normalization of the current and power and subsequent reference on the map shown in FIG. 4 may yield a slightly inaccurate condenser temperature.

While the derived condenser temperature may be slightly inaccurate, use of a temperature sensor 110 disposed generally at a midpoint of a coil 71 of the condenser 70 may be used in conjunction with the derived condenser temperature to determine the actual temperature of the condenser 70. The actual temperature of the condenser 70 is defined as the saturated temperature or saturated pressure of the refrigerant disposed within the condenser 70 generally at a midpoint of the condenser 70 (i.e., when refrigerant disposed within the condenser 70 is at a substantially 50/50 vapor/liquid mixture).

The saturated pressure and, thus, the saturated temperature, may also be determined by placing a pressure sensor proximate to an inlet or an outlet of the condenser 70. While such a pressure sensor accurately provides data indicative of the saturated condensing pressure, such sensors are often costly and intrusive, thereby adding to the overall cost of the refrigeration system 12. While the protection and control system 14 will be described hereinafter and shown in the drawings as including a temperature sensor 110 disposed at a midpoint of the condenser 70, the condenser 70 could alternatively or additionally include a pressure sensor to read the pressure of the refrigerant at an inlet or an outlet of the condenser 70.

The temperature sensor 110 is placed generally at a midpoint of the condenser 70 to allow the temperature sensor 110 to obtain a value indicative of the actual saturated condensing temperature of the refrigerant circulating within the condenser 70. Because the saturated condensing temperature is equivalent to the saturated condensing pressure, obtaining a value of the saturated condensing temperature of the refrigerant within the condenser 70 similarly provides an indication of the saturated condensing pressure of the refrigerant within the condenser 70.

Placement of the temperature sensor 110 within the condenser 70 is generally within an area where the refrigerant mixture within the condenser 70 is a vapor/liquid mixture. Generally speaking, refrigerant exits the compressor 10 and enters the condenser 70 in a gaseous form and exits the condenser 70 in a substantially liquid form. Therefore, typically twenty percent of the refrigerant disposed within the condenser 70 is in a gaseous state (i.e., proximate to an inlet of the condenser 70), twenty percent of the refrigerant disposed within the condenser 70 is in a liquid state (i.e., proximate to an outlet of the condenser 70), and the remaining sixty percent of the refrigerant disposed within the condenser 70 is in a liquid/vapor state. Placement of the temperature sensor 110 within the condenser 70 should be at a mid-point of the condenser coil 71 such that the temperature sensor 110 provides an indication of the actual saturated temperature of the condenser 70 where the refrigerant is in a substantially 50/50 liquid/vapor state.

Under adequate-charge conditions, placement of the temperature sensor 110 at a midpoint of the condenser 70 provides the processing circuitry 88 with an indication of the temperature of the condenser 70 that approximates the saturated condensing temperature and saturated condensing pressure. When the refrigeration system 12 is operating under adequate-charge conditions, the entering vapor refrigerant rejects heat and converts from a gas to a liquid before exiting the condenser 70 as a liquid. Placing the temperature sensor 110 at a midpoint of the condenser 70 allows the temperature sensor 110 to detect a temperature of the condenser 70 and, thus, the refrigerant disposed within the condenser 70, at a point where the refrigerant approximates a 50/50 vapor/liquid state. When operating under adequate-charge conditions, the temperature, as read by the temperature sensor 110, approximates that of the actual condenser temperature, as measured by a pressure sensor.

Figure 7:
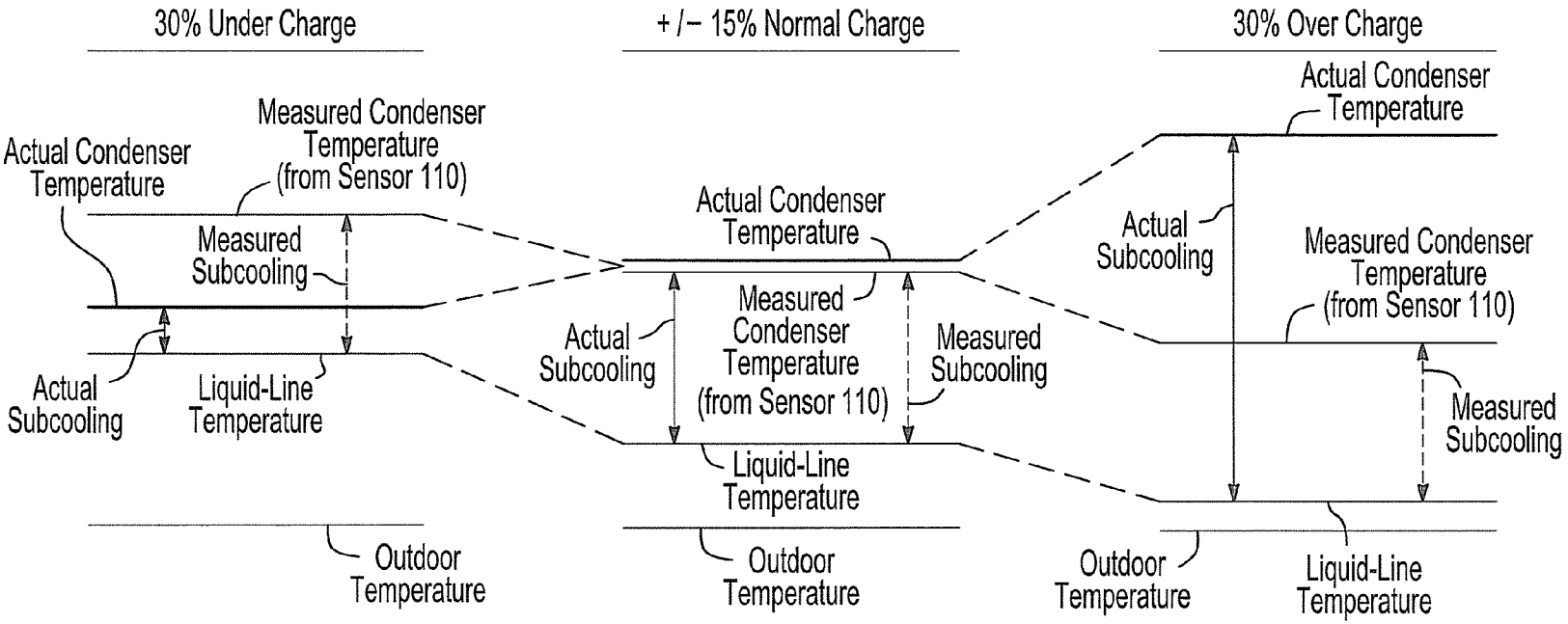
FIG. 7 is a schematic representation of an undercharge condition, an adequate-charge condition, and an overcharge condition of a refrigeration system.

As shown in FIG. 7, when the refrigeration system 12 is adequately charged, such that the refrigerant within the refrigeration system 12 is within +/−15 percent of an optimum-charge condition, the information detected by the temperature sensor 110 at the midpoint of the condenser 70 is close to the actual condenser temperature. This relationship is illustrated in FIG. 7, whereby the measured condenser temperature (i.e., as reported by temperature sensor 110) is close, if not identical, to the actual condenser temperature.

As shown in FIG. 7, when the refrigeration system 12 is operating in the adequate-charge range, the actual subcooling (i.e., the subcooling determined using the saturated condensing temperature or saturated condensing pressure and liquid-line temperature) is substantially equal to the measured subcooling (i.e., determined by subtracting the liquid-line temperature from the temperature detected by the temperature sensor 110). When the refrigeration system 12 operates under the adequate-charge condition, the temperature sensor 110 may be used to accurately provide data indicative of the saturated condensing temperature and the saturated condensing pressure.

While the temperature sensor 110 is sufficient by itself to provide an indication of the saturated condensing temperature and the saturated condensing pressure of the condenser 70 when the refrigeration system 12 operates under the adequate-charge condition, the temperature sensor 110 may not be solely used to determine the saturated condensing temperature when the refrigeration system 12 experiences an extreme-undercharge condition or an extreme-overcharge condition. The extreme-undercharge condition is generally experienced when the volume of refrigerant disposed within the refrigeration system 12 is substantially more than thirty percent less than the optimum-charge of the refrigeration system 12. Similarly, the extreme-overcharge condition is experienced when the refrigerant disposed within the refrigeration system 12 is at least thirty percent more than the optimum charge of the refrigeration system 12.

During the extreme-undercharge condition, less refrigerant is disposed within the refrigeration system 12 than is required. Therefore, refrigerant exiting the compressor 10 and entering the condenser 70 is at an elevated temperature when compared to refrigerant entering the condenser 70 under adequate-charge conditions. Therefore, the entering vapor refrigerant takes longer to reject heat and convert from a gaseous state to a liquid state and therefore converts from the gaseous state to the gas/liquid mixture at a later point along the condenser 70. Because the temperature sensor 110 is disposed generally at a midpoint of the condenser 70 to detect a temperature of a 50/50 vapor/liquid mixture under adequate-charge conditions, the temperature sensor 110 may measure a temperature of the refrigerant within the condenser 70 at a point where the refrigerant may be at approximately a 60/40 gas/liquid state when the refrigeration system 12 is operating in the extreme-undercharge condition.

The reading taken by the temperature sensor 110 provides the processing circuitry 88 with a higher temperature reading that is not indicative of the actual condenser temperature. The decrease in volume of refrigerant circulating within the refrigeration system 12 causes the refrigerant within the condenser 70 to be at a higher temperature and convert from the gaseous state to the liquid state at a later point along a length of the condenser 70. The reading taken by the temperature sensor 110 is therefore not indicative of the actual saturated condensing temperature or saturated condensing pressure.

The above relationship is illustrated in FIG. 7, whereby the actual condenser temperature is shown as being closer to the liquid-line temperature than the elevated temperature reported by the temperature sensor 110. If the processing circuitry 88 relied solely on the information received from the temperature sensor 110, the processing circuitry 88 would make control, protection, and diagnostics decisions for the compressor 10 and/or refrigeration system 12 based on an elevated and incorrect condensing temperature.

When the refrigeration system 12 operates in the extreme-overcharge condition, an excess amount of refrigerant is disposed within the refrigeration system 12 than is required. Therefore, the refrigerant exiting the compressor 10 and entering the condenser 70 is at a reduced temperature and may be in an approximately 40/60 gas/liquid mixture. The reduced-temperature refrigerant converts from the vapor state to the liquid state at an earlier point along the length of the condenser 70 and therefore may be at a partial or fully liquid state when the refrigerant approaches the temperature sensor 110 disposed at a midpoint of the condenser 70. Because the refrigerant is at a lower temperature, the temperature sensor 110 reports a temperature to the processing circuitry 88 that is lower than the actual condenser temperature.

The above relationship is illustrated in FIG. 7, whereby the temperature reading at the midpoint of the condenser 70 is read by the temperature sensor 110 at a point that is much lower than the actual condenser temperature. If the processing circuitry relied solely on the information received from the temperature sensor 110, the processing circuitry 88 would make control, protection and diagnostics decisions for the compressor 10 and/or refrigeration system 12 based on a condenser temperature that is lower than the actual condenser temperature.

To account for the above-described extreme-undercharge condition and the extreme-overcharge condition, the temperature sensor 110 should be verified as being in the adequate-charge range prior to use of data received from the temperature sensor 110 by the processing circuitry 88 in verifying charge within the refrigeration system 12. Although the derived condenser temperature (i.e. using the compressor map of FIG. 4) may be slightly inaccurate, the derived condenser temperature is sufficient to differentiate among the adequate-charge condition, the severe-undercharge condition, and the severe-overcharge condition and, thus, can be used to verify the temperature sensor 110.

Verification of the temperature sensor 110 may be adaptive such that the temperature sensor 110 is continuously monitored by the processing circuitry 88 using the derived condenser temperature during operation of the compressor 10 and refrigeration system 12. In other words, the temperature sensor 110 is verified on a real-time basis during operation of the compressor 10 and refrigeration system 12 to ensure that the temperature sensor 110 provides the processing circuitry 88 with reliable information as to the saturated condensing temperature and is not utilized during extreme-undercharge conditions or extreme-overcharge conditions. To avoid possible false verification of temperature sensor 110 during transient conditions such as at initial start-up or defrost conditions, the processing circuitry 88 may also verify the steady-state stability of both the temperature sensor 110 and the derived condenser temperature data or, alternatively, wait for a pre-determined length of time such as, for example, five to ten minutes following start-up of the compressor 10.

As noted above, the condenser temperature derived using the compressor map of FIG. 4 may be subjected to compressor and/or manufacturing variability. While such variability may affect the derived condenser temperature, the derived condenser temperature may be used to verify the temperature sensor 110 to ensure that the temperature sensor 110 provides an accurate indication as to the saturated condensing temperature and saturated condensing pressure. Once temperature sensor 110 is verified, then the derived condenser temperature can be "calibrated" (adjusted) to the value of the temperature sensor 110 and, thus, becomes more accurate in checking charge within refrigeration system 12.

The protection and control system 14 may use data from the temperature sensor 110 to control the compressor 10 and/or refrigeration system 12, as long as the refrigeration system 12 is operating under adequate-charge conditions. However, the temperature sensor 110 should be verified using the derived condenser temperature (i.e., derived by using the compressor map of FIG. 4) to ensure the refrigeration system 12 is operating under adequate-charge conditions.

Once the refrigeration system 12 is configured and the temperature sensor 110 is installed, refrigerant may be circulated throughout the refrigeration system 12 by the compressor 10 such that a current drawn by the compressor 10 may be referenced on the compressor map of FIG. 4. As described above, referencing the power or current drawn by the compressor on the compressor map of FIG. 4 provides a derived condenser temperature, which is an approximation of the actual condenser temperature.

The derived condenser temperature may be stored for reference by the protection and control system 14 in continuously verifying the temperature sensor 110. Once the derived condensing temperature is stored by the protection and control system 14, a temperature reading of the condenser 70 is taken by the temperature sensor 110 and sent to the processing circuitry 88. The processing circuitry 88 may compare the temperature data received from the temperature sensor 110 to the derived condensing temperature. If the temperature value received from the temperature sensor 110 varies from the derived condensing temperature by a predetermined amount, the processing circuitry 88 may declare a severe-overcharge condition or a severe-undercharge condition. If, on the other hand, the temperature data received from the temperature sensor 110 suggests that a temperature of the condenser 70 approximates that of the derived condenser temperature, the processing circuitry 88 may declare that the refrigeration system 12 is operating under adequate-charge conditions such that data received from the temperature sensor 110 may be used by the processing circuitry 88 in controlling the compressor 10 and/or refrigeration system 12.

While a direct comparison of the temperature data received from the temperature sensor may be made relative to the derived condensing temperature, the processing circuitry 88 may additionally or alternatively compare a calculated subcooling value (determined by using the derived condenser temperature) to a measured subcooling value (determined using information received from the temperature sensor 110).

Figure 8:
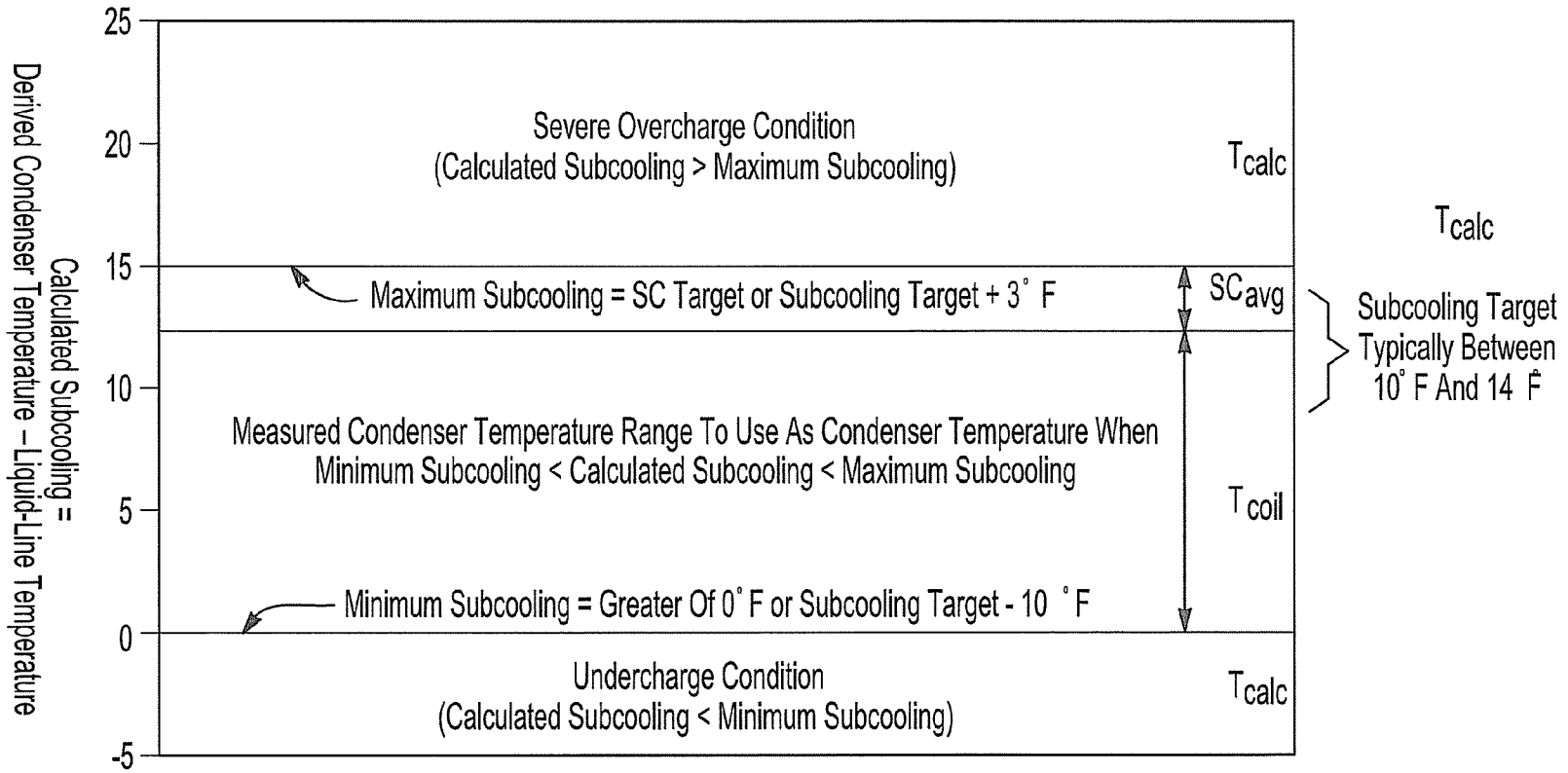
FIG. 8 is a graphical representation of an undercharge condition, an adequate-charge condition, and an overcharge condition for a refrigeration system, as defined by subcooling valves for the refrigeration system.

With particular reference to FIG. 8, a graph detailing a severe-overcharge condition, a severe-undercharge condition, and an adequate-charge condition for the refrigeration system 12 is provided. A calculated subcooling value is referenced on the graph to distinguish between the severe-overcharge condition, severe-undercharge condition, and adequate-charge condition and is determined by subtracting the liquid-line temperature data (received from the liquid line temperature sensor 84) from the derived condensing temperature (i.e., as determined by referencing the current drawn by the compressor 10 on the compressor map of FIG. 4). The calculated subcooling value may be plotted on a Y-axis of the graph of FIG. 8 to provide a map for the processing circuitry 88 of the protection and control system 14 to use in determining a severe-overcharge condition, a severe-undercharge condition, and an adequate-charge condition.

As shown in FIG. 8, the severe-undercharge condition is declared by the processing circuitry 88 when the calculated subcooling of the refrigeration system 12 is less than a minimum subcooling value. In one configuration, the minimum subcooling for the refrigeration system 12 is the greater of zero degrees Fahrenheit or a target subcooling value minus ten degrees Fahrenheit. The minimum adequate subcooling is typically defined where the condenser 70 begins to lose its liquid phase. For most systems, the optimum target subcooling is typically in the range of approximately ten to 14 degrees. In one configuration, the optimum target subcooling value is approximately 13 degrees Fahrenheit.

The severe-overcharge condition may be declared by the processing circuitry 88 when the calculated subcooling of the refrigeration system 12 is greater than a maximum subcooling. The maximum subcooling may be the lower value of 17 degrees Fahrenheit or an optimum target subcooling value plus three degree Fahrenheit. Again, in one configuration, the target subcooling value is approximately 13 degrees Fahrenheit.

Based on the above-described severe-undercharge condition and severe-overcharge condition, the adequate-charge condition is generally defined as being between the severe-undercharge condition and the severe-overcharge condition, whereby the adequate-charge condition may be declared by the processing circuitry 88 when the calculated subcooling of the refrigeration system is greater than the minimum subcooling and less than the maximum subcooling. When the processing circuitry 88 declares that the refrigeration system 12 is operating at an adequate-charge condition, data received from the temperature sensor 110 may be used by the processing circuitry 88 to control, protect, and diagnose the compressor 10 and/or refrigeration system 12.

The processing circuitry 88 may utilize the relationship shown in FIG. 8 by comparing the calculated subcooling value using the derived condensing temperature, as determined by referencing the current drawn by the compressor 10 on the compressor map of FIG. 4, based on a particular subcooling target of the refrigeration system 12. In one configuration, the subcooling target may be between ten degrees Fahrenheit and 14 degrees Fahrenheit, thereby defining the adequate-charge conditions as being between a calculated subcooling value of 17 degrees Fahrenheit at a maximum point and a minimum subcooling value of zero degrees Fahrenheit. When the calculated subcooling value exceeds the maximum subcooling value, the processing circuitry declares a severe-overcharge condition and when the calculated subcooling value is less than the minimum subcooling value, the processing circuitry declares a severe-undercharge condition.

When the processing circuitry 88 declares a severe-overcharge condition based on the calculated subcooling determined from the derived condenser temperature, a technician may be alerted to reduce the volume of refrigerant circulating within the refrigeration system 12 to within the adequate-charge range. Conversely, when the processing circuitry 88 declares a severe undercharge condition, a technician may be alerted to add refrigerant to the refrigeration system 12 to bring the level of refrigerant circulating within the refrigeration system 12 to within the adequate-charge range. Once the processing circuitry 88 determines that the refrigeration system 12 has returned to the adequate-charge condition, the processing circuitry 88 may once again utilize subcooling data received from the "verified" temperature sensor 110. Information from the verified temperature sensor 110 may then be used to "calibrate" the derived condenser temperature to enhance the accuracy of the derived condenser temperature in guiding the technician further in adding or removing charge to obtain the optimum target subcooling specified by the manufacturer.

Figure 9:
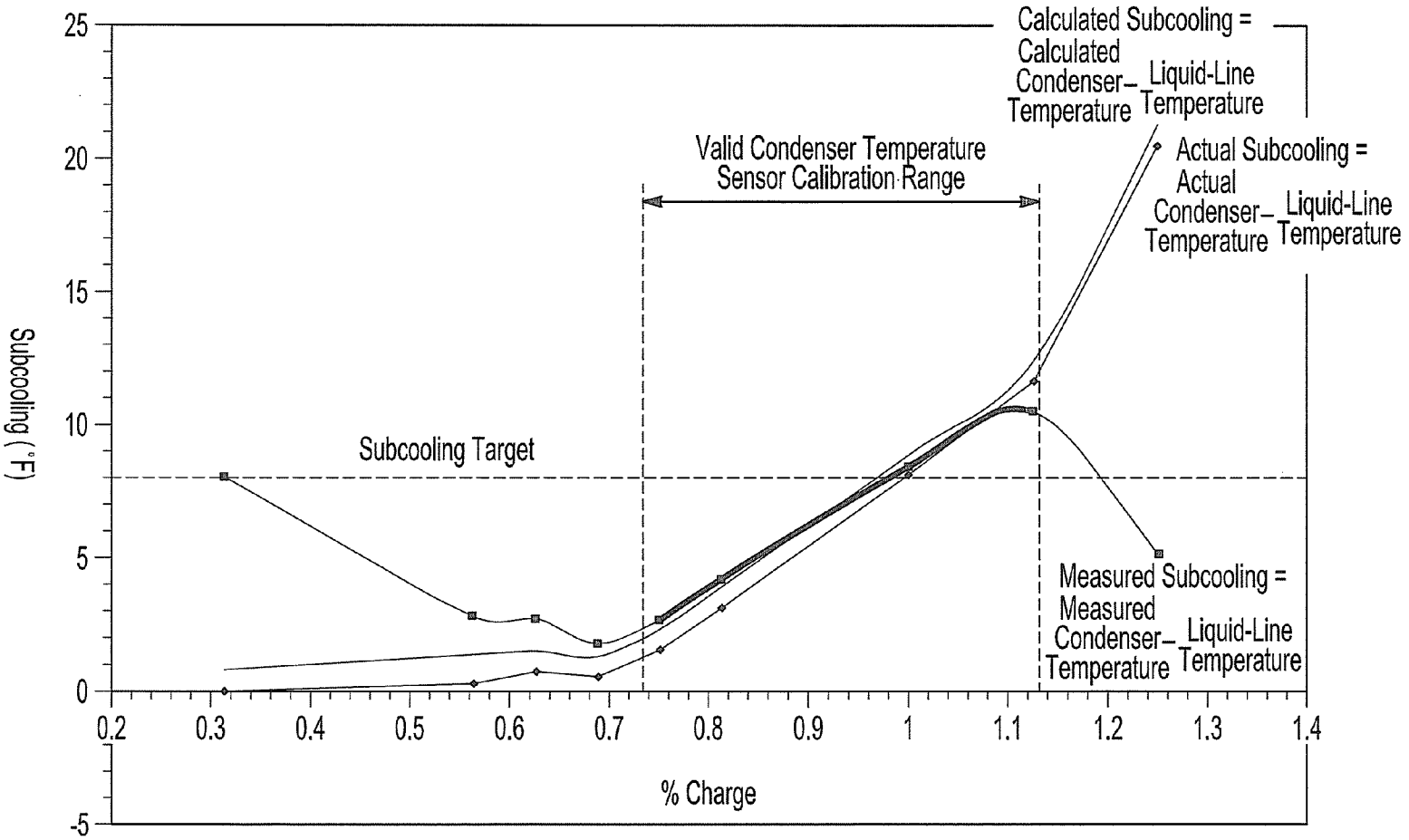
FIG. 9 is a graph of subcooling versus charge showing a valid condenser-temperature sensor calibration range.

With particular reference to FIG. 9, the above relationship between the actual subcooling of the refrigeration system 12 and the calculated subcooling of the refrigeration system 12 (i.e., determined by subtracting the liquid line temperature from the derived condensing temperature) is provided and is contrasted with a measured subcooling value determined by subtracting the liquid line temperature from data received from the temperature sensor 110. The actual subcooling value may be determined during a test condition by using a pressure sensor at the inlet or outlet of the condenser 70 to determine the actual saturated condensing pressure of the condenser 70. This value may be used to determine the actual subcooling of the refrigeration system 12 and may be used to compare the actual subcooling of the refrigeration system 12 to the subcooling of the refrigeration system 12, as determined by subtracting the liquid line temperature from the determined condensing temperature.

As shown in FIG. 9, the actual subcooling value is similar to the calculated subcooling value (i.e., using the determined condensing temperature), regardless of the charge of the refrigeration system. Specifically, even when the refrigeration system 12 is in a severe-undercharge condition or a severe-overcharge condition, the calculated subcooling value in this particular case approximates the actual subcooling of the refrigeration system 12. Conversely, the measured subcooling value (i.e., determined by subtracting the liquid line temperature of the refrigeration system 12 from the temperature data received from the temperature sensor 110) only approximates the actual condenser temperature when the charge of the refrigeration system 12 is at a adequate-charge condition, as described above and illustrated in FIG. 8.

When the refrigeration system 12 experiences a severe-undercharge condition or a severe-overcharge condition, the measured subcooling of the refrigeration system 12 deviates from the actual subcooling of the refrigeration system 12. Therefore, when the refrigeration system 12 experiences a severe-undercharge condition or a severe-overcharge condition, the temperature sensor 110 should not be used by the processing circuitry 88 to diagnose, protect, and control the compressor 10 and/or refrigeration system 12. However, when the charge of the refrigeration system 12 is within the adequate-charge range, data from the temperature sensor 110 may be used by the processing circuitry 88 to control and diagnose the compressor 10 and/or refrigeration system 12.

Figure 10:
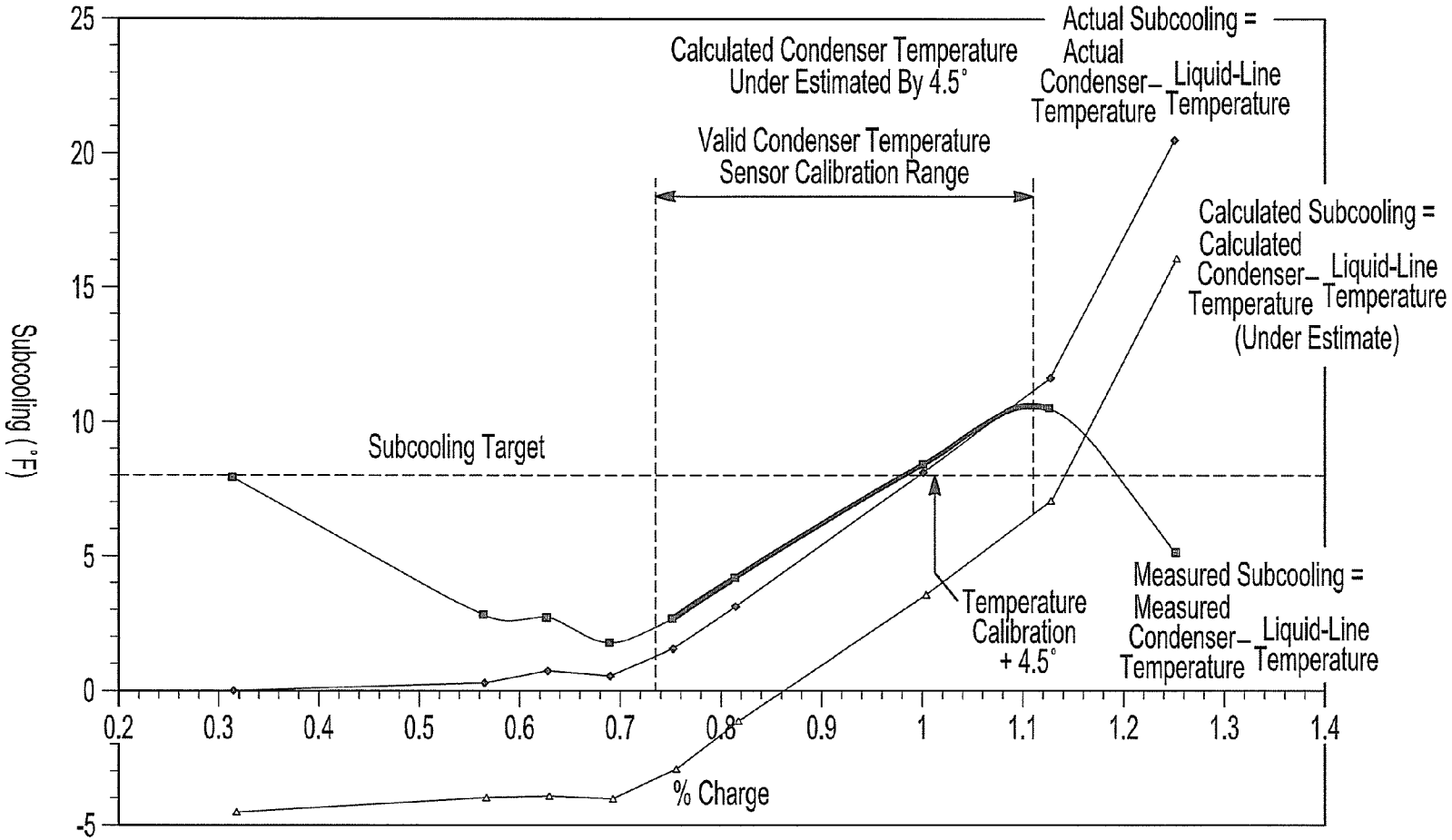
FIG. 10 is a graphical representation of subcooling versus charge showing calibration of a condenser-temperature sensor calibrated up approximately 4.5 degrees Fahrenheit.

With particular reference to FIG. 10, the calculated subcooling of the refrigeration system 12 determined by subtracting the liquid line temperature from the determined condenser temperature is shown as being offset from the actual subcooling of the refrigeration system 12 by approximately 4.5 degrees Fahrenheit. The above discrepancy between the calculated subcooling value and the actual subcooling value may be attributed to production variability affecting approximation of the determined subcooling value.

As set forth above, the determined condenser temperature may vary slightly from the actual subcooling value due to compressor variation and/or errors in the compressor map (FIG. 4). Therefore, the derived condenser temperature must be calibrated (adjusted) based on temperature sensor 110. Adjustment to the derived condenser temperature is performed only when the refrigeration system 12 is known to be operating within the adequate-charge range.

A pressure sensor may be positioned within the condenser 70 to determine the actual condensing pressure of the condenser 70. Once the processing circuitry 88 determines that the refrigeration system 12 is operating within the adequate-charge range, the calculated subcooling of the refrigeration system 12 may be compared to the actual subcooling value of the refrigeration system 12.

Figure 11:
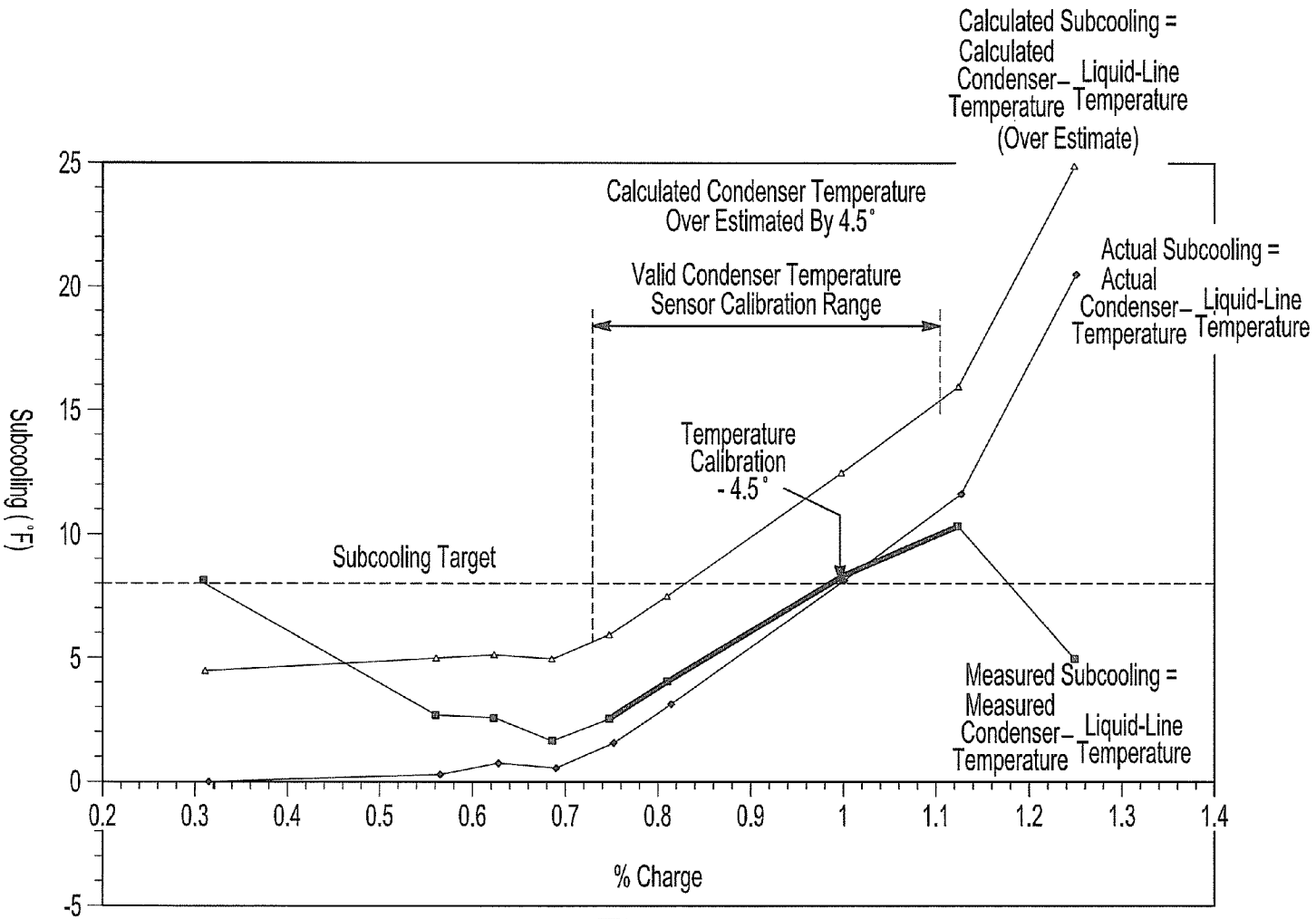
FIG. 11 is a graphical representation of subcooling versus charge detailing a condenser-temperature sensor value calibrated down approximately 4.5 degrees Fahrenheit.

As shown in FIG. 8, the calculated subcooling value of the refrigeration system 12 should approximate the actual subcooling value of the refrigeration system 12, regardless of the charge of the refrigeration system 12. If it is determined that the refrigeration system 12 is operating within the adequate-charge range, and the calculated subcooling value is offset from the actual subcooling value, then the calculated subcooling value may be corrected by calibrating the calculated subcooling value up or down until the calculated subcooling value approximates that of the measured subcooling value from the temperature sensor 110. In FIG. 10, the calculated subcooling value is calibrated up approximately 4.5 degrees Fahrenheit and in FIG. 11, the calculated subcooling value is calibrated down approximately 4.5 degrees Fahrenheit until the calculated subcooling value approximates that of the actual subcooling value.

Once the calculated subcooling value is calibrated up or down such that the calculated subcooling value approximates that of the actual subcooling value of the refrigeration system 12, the calculated subcooling value may be used continuously to verify the temperature sensor 110. As noted above, if the calculated subcooling value indicates that the refrigeration system 12 is operating within the adequate-charge range, the processing circuitry 88 may use information from the temperature sensor 110 to control the compressor 10 and/or refrigeration system 12. If the calculated subcooling value indicates that the refrigeration system 12 is operating in a severe-undercharge condition or a severe-overcharge condition, the processing circuitry 88 may not use information from the temperature sensor 110 in controlling the compressor 10 and/or refrigeration system 12, but rather, should use the determined condenser temperature in controlling the compressor 10 and/or refrigeration system 12. When the refrigeration system 12 is operating in the severe-undercharge condition or the severe-overcharge condition, the temperature information received by the processing circuitry 88 from the temperature sensor 110 is not valid, as the data is influenced by the severe-undercharge condition or severe-overcharge condition of the refrigeration system 12, as set forth above and shown in FIG. 7.

After the processing circuitry 88 completes the above calibration process, the difference between the temperature sensor 110 and the derived condenser temperature (from the compressor map in FIG. 4) can be used by the processing circuitry 88 to diagnose compressor faults when a difference between the measured condenser temperature and the derived condenser temperature exceeds a threshold value. Typically, a one-degree increase in condenser temperature increases compressor power by approximately 1.3 percent. Therefore, for example, if the derived condenser temperature is higher than the measured condenser temperature by more than ten degrees, the processing circuitry 88 may declare that the compressor is operating at approximately 13 percent less efficient than expected. Such operational inefficiencies may be attributed an internal compressor fault such as, for example, a bearing failure or an electrical fault such as a motor defect or a bad capacitor. Likewise, if the derived condenser temperature is lower than the measured condenser temperature by more than approximately ten degrees, the processing circuitry 88 may declare that the compressor is operating at about 13 percent less capacity than expected. Such operational inefficiencies may be attributed to an internal leak or faulty seal, for example.

The processing circuitry 88 may also perform diagnostics on the mid-coil temperature sensor 110 and/or the liquid-line temperature sensor 84 to detect sensor faults such as, for example, an electrical short or electrically open sensor before performing calibration. The processing circuitry 88 may also continuously monitor the temperature sensor 110 to ensure that the temperature sensor 110 reads higher than the liquid-line temperature sensor 84 to confirm the sensor readings are valid and have not drifted over time. Similarly, the processing circuitry 88 may also check to ensure that the derived condenser temperature reads higher than the liquid-line temperature sensor 84. Finally, the processing circuitry 88 may also check to ensure the liquid-line temperature sensor 84 reads higher than the ambient temperature sensor 86.

The above-described sensor monitoring and checking is able to confirm the expected descending order of the condenser temperature (either measured by the temperature sensor 110 or derived using a compressor map such as in FIG. 4), the liquid-line temperature measured by sensor 84, and the ambient temperature measured by sensor 86, to confirm that the sensors have not drifted and are operating within a predetermined range.

What is claimed is:

1. A system comprising:

a refrigeration circuit including a condenser and a compressor having a motor;

a first sensor producing a signal indicative of a detected condenser temperature of said condenser;

a second sensor producing a signal indicative of one of current and power drawn by said motor; and processing circuitry in communication with said first sensor and said second sensor and operable to determine a derived, non-measured condenser temperature by referencing said current or power signal on a map of current or power versus condenser temperature, said processing circuitry operable to compare said derived condenser temperature to said detected condenser temperature to determine a charge level of said refrigeration circuit.

2. The system of claim 1, wherein said processing circuitry determines an overcharge condition or an undercharge condition if said derived condenser temperature varies from said detected condenser temperature by a predetermined amount and determines an adequate-charge condition if said derived condenser temperature varies from said detected condenser temperature less than said predetermined amount.

3. The system of claim 2, wherein said processing circuitry controls said refrigeration circuit based on said detected condenser temperature when said normal-charge condition is determined and controls said refrigeration circuit based on said derived condenser temperature when said overcharge condition or said undercharge condition is determined.

4. The system of claim 1, wherein said first sensor is positioned at one of an outlet and a mid-point of said condenser.

5. The system of claim 1, wherein said processing circuitry determines an adequate-charge condition when said detected condenser temperature is representative of a saturated condensing temperature.

6. The system of claim 1, wherein said processing circuitry determines one of an overcharge condition and an undercharge condition when said detected condenser temperature is not representative of a saturated condensing temperature.

7. The system of claim 1, further comprising a second third sensor producing a signal indicative of a liquid-line temperature.

8. The system of claim 7, wherein said processing circuitry determines a subcooling based on said liquid-line temperature.

9. The system of claim 1, wherein said processing circuitry determines said derived condenser temperature independent from information received from said first sensor.

10. A method comprising:

detecting by a first sensor a temperature of a condenser;

communicating said detected condenser temperature to processing circuitry;

deriving by said processing circuitry a non-measured temperature of said condenser by referencing one of current and power drawn by a compressor on a map of current or power versus condenser temperature;

comparing by said processing circuitry said derived condenser temperature with said detected condenser temperature; and determining one of an overcharge condition, an undercharge condition, and an adequate-charge condition based on said comparing.

11. The method of claim 10, wherein one of said overcharge condition and said undercharge condition is determined when said derived condenser temperature deviates from said detected condenser temperature by more than a predetermined amount.

12. The method of claim 11, wherein said adequate-charge condition is determined when said derived condenser temperature deviates from said detected condenser temperature by a value that is less than or equal to said predetermined amount.

13. The method of claim 10, wherein said adequate-charge condition is determined when said derived condenser temperature deviates from said detected condenser temperature by a value that is less than or equal to said predetermined amount.

14. The method of claim 10, further comprising controlling by said processing circuitry at least one of a refrigeration circuit and a compressor based on said detected condenser temperature when said adequate-charge condition is determined and controlling by said processing circuitry at least one of said refrigeration circuit and said compressor based on said derived condenser temperature when one of said overcharge condition or said undercharge condition is determined.

15. The method of claim 10, further comprising determining said adequate-charge condition when said detected condenser temperature is representative of a saturated condensing temperature.

16. The method of claim 10, further comprising determining one of said overcharge condition and said undercharge condition when said detected condenser temperature is not representative of said saturated condensing temperature.

17. The method of claim 10, further comprising detecting by a second sensor a signal indicative of a liquid-line temperature.

18. The method of claim 17, further comprising determining by said processing circuitry a subcooling based on said liquid-line temperature.

19. The method of claim 10, wherein said deriving said condenser temperature includes deriving said condenser temperature based on information independent from information received from said first sensor.

* * * * *